US010013933B2

(12) United States Patent
Tamaki et al.

(10) Patent No.: US 10,013,933 B2
(45) **Date of Patent: *Jul. 3, 2018**

(54) IMAGE DISPLAY PANEL, IMAGE DISPLAY DEVICE AND ELECTRONIC APPARATUS

(71) Applicant: Japan Display Inc., Tokyo (JP)

(72) Inventors: Masaya Tamaki, Tokyo (JP); Amane Higashi, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/661,616

(22) Filed: Jul. 27, 2017

(65) Prior Publication Data

US 2017/0323604 A1 Nov. 9, 2017

Related U.S. Application Data

(63) Continuation of application No. 14/854,904, filed on Sep. 15, 2015, now Pat. No. 9,747,849.

(30) Foreign Application Priority Data

Sep. 16, 2014 (JP) ..... 2014-188161

(51) Int. Cl.
*G09G 3/36* (2006.01)

(52) U.S. Cl.
CPC ... *G09G 3/3607* (2013.01); *G09G 2300/0452* (2013.01); *G09G 2320/0242* (2013.01); *G09G 2340/06* (2013.01)

(58) Field of Classification Search
CPC ..... G09G 3/3607
USPC ..... 345/690
See application file for complete search history.

(56) References Cited

U.S. PATENT DOCUMENTS

| | | | | |
|---|---|---|---|---|
| 8,432,412 | B2 | 4/2013 | Sakaigawa et al. | |
| 9,747,849 | B2 * | 8/2017 | Tamaki | G09G 3/3607 |
| 2009/0315921 | A1 | 12/2009 | Sakaigawa et al. | |
| 2010/0085517 | A1 | 4/2010 | Hong | |
| 2011/0181634 | A1 | 7/2011 | Higashi et al. | |

(Continued)

FOREIGN PATENT DOCUMENTS

| | | |
|---|---|---|
| CN | 103886839 A | 6/2014 |
| JP | 2011-154321 A | 8/2011 |
| JP | 2013-186294 | 9/2013 |

OTHER PUBLICATIONS

Chinese Office Action dated Jul. 28, 2017 for corresponding Chinese Patent Application No. 20150587782.8.

*Primary Examiner* — Fred Tzeng
(74) *Attorney, Agent, or Firm* — Michael Best & Friedrich LLP

(57) ABSTRACT

According to an aspect, an image display panel includes: a first pixel including (d−1) sub pixels, which are first to (d−2)-th sub pixels and a (d−1)-th sub pixel, and a second pixel that is adjacent to the first pixels and includes (d−1) sub pixels, which are first to (d−2)-th sub pixels and a d-th sub pixel. A region of the image display panel includes a first pixel display region and a second pixel display region. The first to (d−2)-th sub pixels of the first pixel, one part of the (d−1)-th sub pixel, and one part of the d-th sub pixel are arranged in the first pixel display region. The first to (d−2)-th sub pixels of the second pixel, the other part of the (d−1)-th sub pixel, and the other part of the d-th sub pixel are arranged in the second pixel display region.

9 Claims, 25 Drawing Sheets

(56) References Cited

U.S. PATENT DOCUMENTS

| | | | |
|---|---|---|---|
| 2012/0013649 | A1 | 1/2012 | Higashi et al. |
| 2012/0050345 | A1 | 3/2012 | Higashi et al. |
| 2013/0027765 | A1 | 1/2013 | Kim et al. |
| 2014/0125689 | A1 | 5/2014 | Ikeda et al. |
| 2014/0168284 | A1 | 6/2014 | Kabe et al. |
| 2014/0218386 | A1 | 8/2014 | Tatsuno et al. |
| 2014/0267471 | A1 | 9/2014 | Harada et al. |
| 2014/0285539 | A1 | 9/2014 | Kurokawa et al. |
| 2014/0292840 | A1 | 10/2014 | Harada et al. |
| 2016/0078828 | A1 | 3/2016 | Tamaki et al. |

* cited by examiner

IMAGE DISPLAY PANEL, IMAGE DISPLAY DEVICE AND ELECTRONIC APPARATUS

CROSS-REFERENCE TO RELATED APPLICATIONS

The present Application is a Continuation Application of U.S. patent application Ser. No. 14/854,904 filed Sep. 15, 2015, which in turn claims priority from Japanese Application No. 2014-188161, filed on Sep. 16, 2014, the contents of which are incorporated by reference herein in their entirety.

BACKGROUND

1. Technical Field

The present disclosure relates to an image display panel, an image display device, and an electronic apparatus.

2. Description of the Related Art

Display devices such as liquid crystal display devices include transmissive display devices and reflective display devices. Transmissive display devices display images with light transmitted through a liquid crystal panel by emitting the light from a backlight provided on the back side of the liquid crystal panel. Reflective display devices display images with reflected light obtained by reflecting light emitted from the front of a liquid crystal panel toward the liquid crystal panel.

There is a technique in which a white sub pixel serving as a fourth sub pixel is added to red, green, and blue sub pixels serving as first to third sub pixels of a related art. As described in Japanese Patent Application Laid-open Publication No. 2011-154321 (JP-A-2011-154321), there is an image display panel in which a group of pixels including a first pixel including first, second, and third sub pixels and a second pixel including first, second, and fourth sub pixels are arranged in a two-dimensional (2D) matrix form.

According to JP-A-2011-154321, the first pixel does not include the fourth sub pixel, and the second pixel does not include the third sub pixel. Thus, for example, when it is desired to display a color of the fourth sub pixel, it is difficult for the first pixel to express the color. Similarly, when it is desired to display a color of the third sub pixel, it is difficult for the second pixel to express the color. Thus, in this case, an image to be displayed is likely to deteriorate.

For the foregoing reasons, there is a need for an image display panel, an image display device, and an electronic apparatus that can reduce deterioration of an image.

SUMMARY

According to an aspect, an image display panel includes: a first pixel including (d−1) sub pixels, which are first to (d−2)-th sub pixels and a (d−1)-th sub pixel, when d is an integer of four or more, each of the (d−1) sub pixels displaying a different color from at least another sub pixel; and a second pixel that is adjacent to the first pixels and includes (d−1) sub pixels, which are first to (d−2)-th sub pixels and a d-th sub pixel, each of the (d−1) sub pixels displaying a different color from at least another sub pixel. The first pixel and the second pixel are periodically arranged in a two-dimensional matrix form to display an image. A region of the image display panel in which an image is displayed is divided into a two-dimensional matrix form in units of pixel display regions, each pixel display region serving as a region in which a color is displayed based on color information of a corresponding input signal that is input to the image display panel. The pixel display region includes a first pixel display region and a second pixel display region adjacent to the first pixel display region. The first to (d−2)-th sub pixels of the first pixel, one part of the (d−1)-th sub pixel, and one part of the d-th sub pixel are arranged in the first pixel display region. The first to (d−2)-th sub pixels of the second pixel, the other part of the (d−1)-th sub pixel, and the other part of the d-th sub pixel are arranged in the second pixel display region.

DETAILED DESCRIPTION

Figure 1:
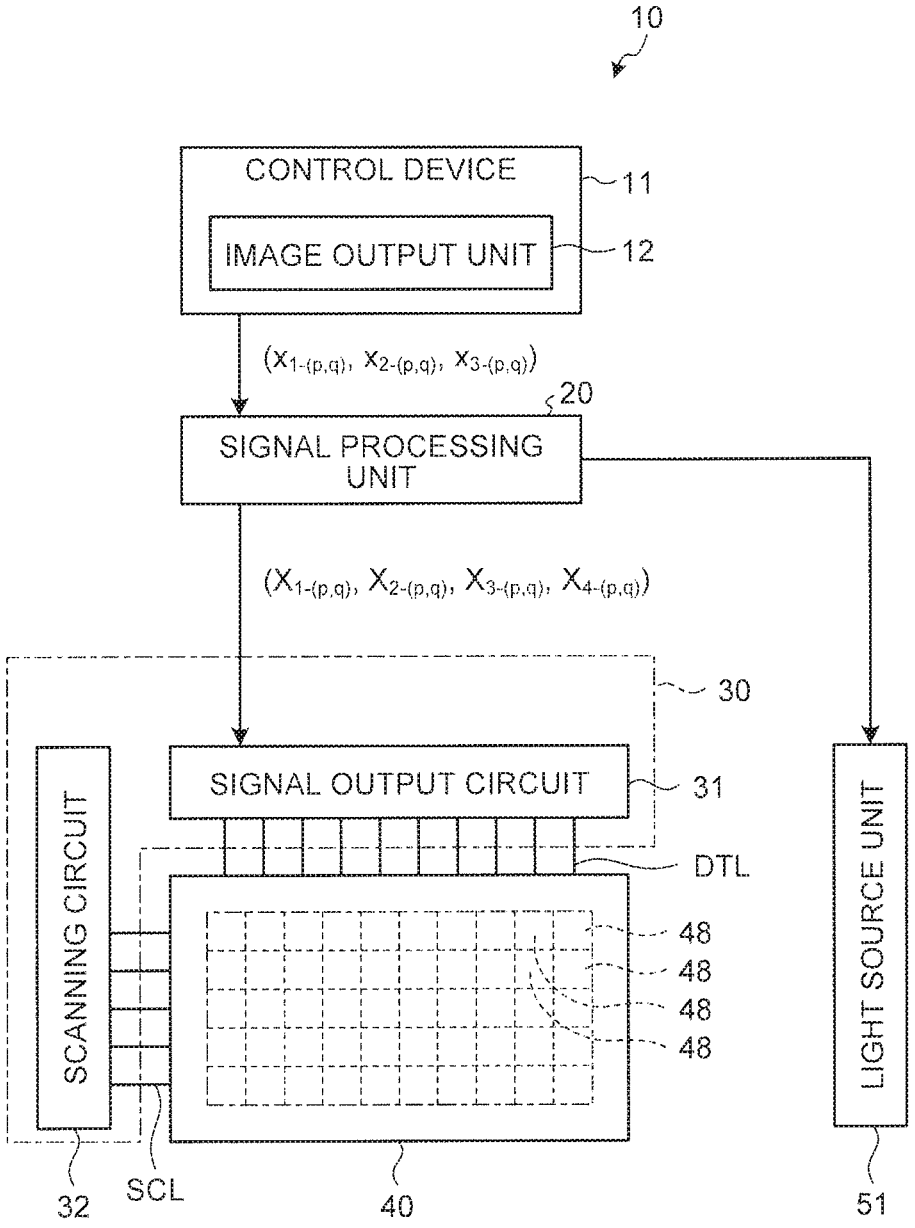
FIG. 1 is a block diagram illustrating an example of a configuration of a display device according to a first embodiment.

Embodiments of the present disclosure will be described in detail in the following order with reference to the appended drawings.

1. Embodiments
2. Application examples

1. Embodiments

Hereinafter, embodiments of the present disclosure will be described with reference to the appended drawings. The disclosure is merely an example, and of course, appropriate modifications that are easily derived by those having skill in the art within the gist of the invention are included in the scope of the present invention. In order to further clarify the drawings, there are cases in which, for example, the width, the thickness, or the shape of each unit are illustrated schematically compared to an actual form, but it is merely an example and not intended to limit an interpretation of the present invention. In the present specification and the respective drawings, the same elements as those in the already-described drawings are denoted by the same reference numerals, and a detailed description thereof will be appropriately omitted.

First Embodiment

Overall Configuration of Display Device

Figure 2:
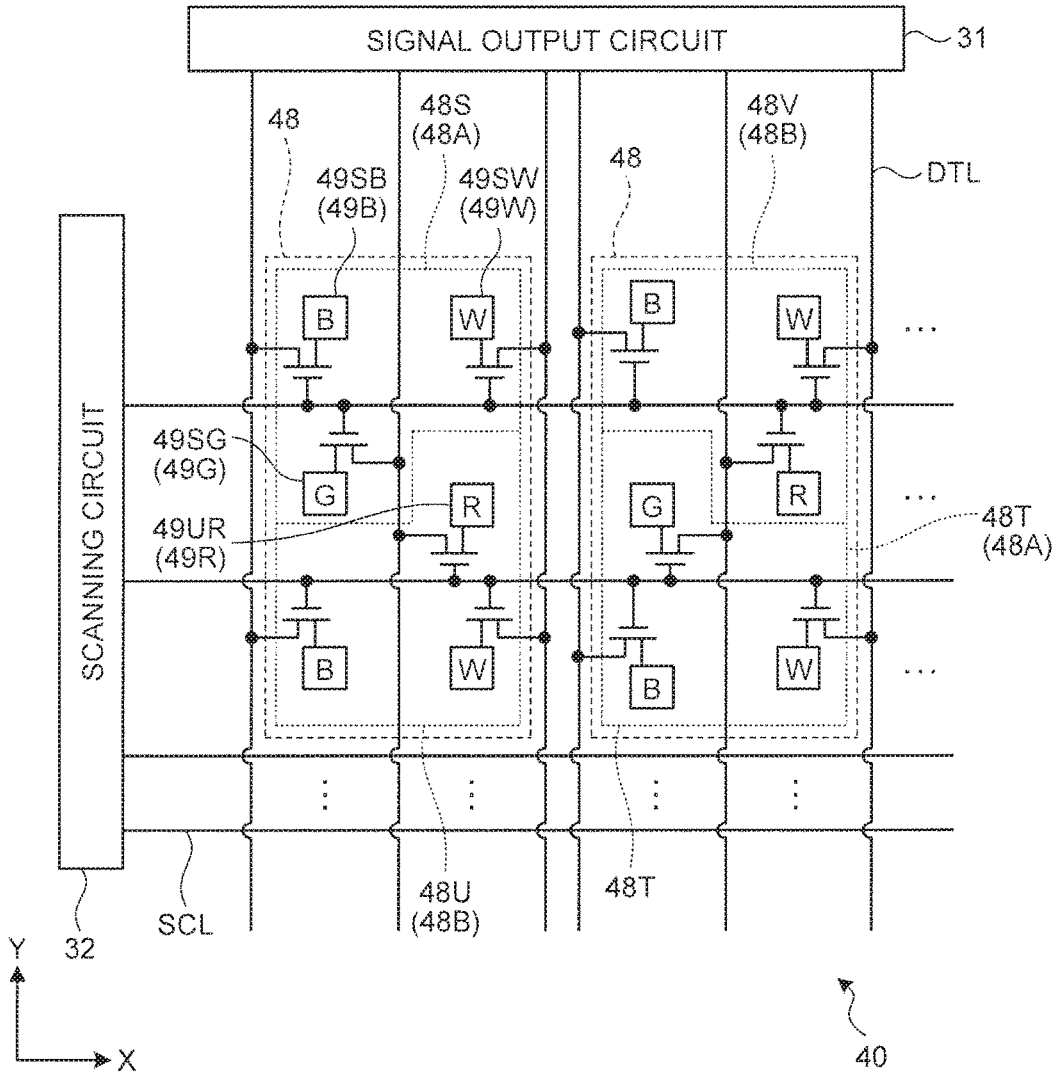
FIG. 2 is a conceptual diagram of an image display panel according to the first embodiment.

FIG. 1 is a block diagram illustrating an example of a configuration of a display device according to a first embodiment. FIG. 2 is a conceptual diagram of an image display panel according to the first embodiment. A display device 10 of the first embodiment includes a signal processing unit 20, an image-display-panel driving unit 30, an image display panel 40, and a light source unit 51 as illustrated in FIG. 1. The signal processing unit 20 receives an input signal (RGB data) from an image output unit 12 of a control device 11, and transfers a signal generated by performing a certain data conversion process on the input signal to the respective units of the display device 10. The image-display-panel driving unit 30 controls driving of the image display panel 40 based on the signal from the signal processing unit 20. The image display panel 40 displays an image based on the signal from the image-display-panel driving unit 30. The display device 10 displays an image by reflecting ambient light by the image display panel 40. When used outdoor during the night or in a dark place in which ambient light is insufficient, the display device 10 can display an image by reflecting light emitted from the light source unit 51 by the image display panel 40.

Configuration of Signal Processing Unit

The signal processing unit 20 is an arithmetic processing unit that controls an operation of the image display panel 40 through the image-display-panel driving unit 30 as illustrated in FIG. 1. The signal processing unit 20 is coupled with the image-display-panel driving unit 30 and the light source unit 51.

The signal processing unit 20 processes an input signal input from an external application processor (a host CPU) (not illustrated), and generates an output signal. The signal processing unit 20 converts an input value of the input signal into an extension value (output signal) of an extended color space (a HSV color space in the first embodiment) extended by a first color, a second color, a third color, and a fourth color to generate the output signal. The signal processing unit 20 outputs the generated output signal to the image-display-panel driving unit 30. The first color, the second color, the third color, and the fourth color will be described later. In the first embodiment, the extended color space is the HSV (Hue-Saturation-Value, Value is also called Brightness) color space but not limited to this example. The extended color space may be any other coordinate system such as an XYZ color space, a YUV space.

Figure 3:
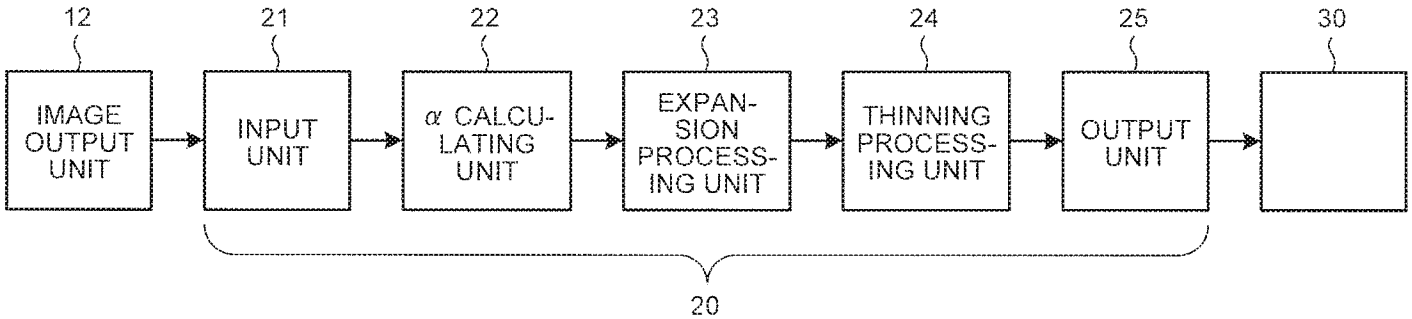
FIG. 3 is a block diagram illustrating a concept of a configuration of a signal processing unit according to the first embodiment.

FIG. 3 is a block diagram illustrating an overview of a configuration of the signal processing unit according to the first embodiment. The signal processing unit 20 includes an input unit 21, an $\alpha$ calculating unit 22, an expansion processing unit 23, a thinning processing unit 24, and an output unit 25 as illustrated in FIG. 3.

The input unit 21 receives the input signal from the image output unit 12 of the control device 11. The $\alpha$ calculating unit 22 calculates an expansion coefficient $\alpha$ based on the input signal input to the input unit 21. A process of calculating the expansion coefficient $\alpha$ will be described later. The expansion processing unit 23 performs an expansion process on the input signal using the expansion coefficient $\alpha$ calculated by the $\alpha$ calculating unit 22 and the input signal input to the input unit 21. In other words, the expansion processing unit 23 converts the input value of the input signal into an extension value of the extended color space (the HSV color space in the first embodiment) extended by the first color, the second color, the third color, and the fourth color to generate an output signal having color information of the first to fourth colors. The expansion process will be described later. The thinning processing unit 24 thins out the output signal by excluding the color information of the third color or the color information of the fourth color from the output signal having the color information of the first to fourth colors. In other words, the thinning processing unit 24 generates a corrected output signal having the color information of the first to third colors or a corrected output signal having the color information of the first color, the second color, and the fourth color from the output signal having the color information of the first to fourth colors. The output unit 25 outputs the corrected output signal generated by the thinning processing unit 24 to the image-display-panel driving unit 30. The signal processing of the signal processing unit 20 described above is merely an example and not intended to limit an interpretation of the present invention.

Configuration of Image-Display-Panel Driving Unit

The image-display-panel driving unit 30 includes a signal output circuit 31 and a scanning circuit 32 as illustrated in FIGS. 1 and 2. The image-display-panel driving unit 30 holds a video signal in the signal output circuit 31 and sequentially outputs the video signal to the image display panel 40 from the signal output circuit 31. More specifically, the signal output circuit 31 outputs an image output signal having a certain potential according to the output signal of the signal processing unit 20 to the image display panel 40. The signal output circuit 31 is electrically coupled with the image display panel 40 via a signal line DTL. The scanning circuit 32 controls an ON/OFF operation of a switching element (for example, a TFT) for controlling operations (light transmittance) of sub pixels 49 in the image display panel 40. The scanning circuit 32 is electrically coupled with the image display panel 40 via a scanning SCL.

Configuration of Image Display Panel

Figure 4:
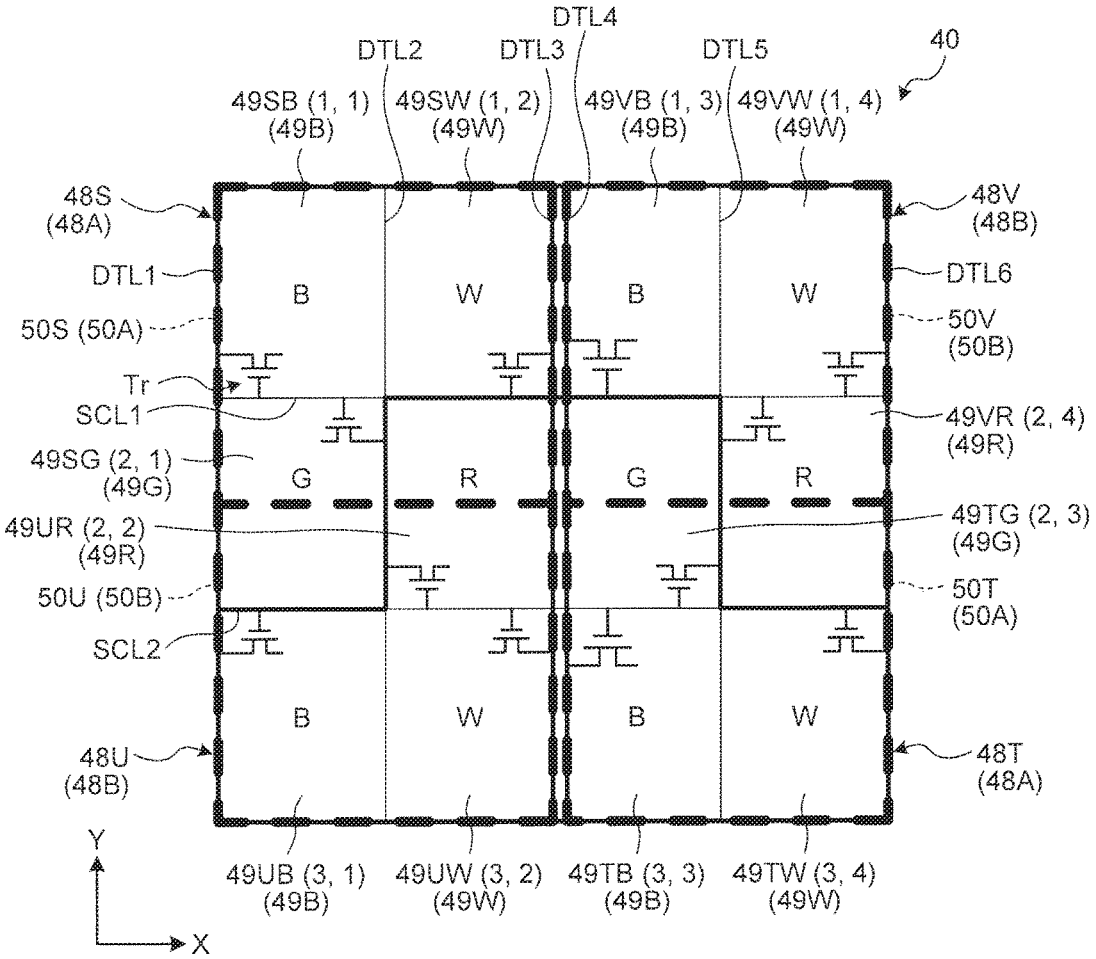
FIG. 4 is a schematic diagram illustrating a pixel array of the image display panel according to the first embodiment.

Next, the image display panel 40 will be described. First, the pixel array of the image display panel 40 will be described. FIG. 4 is a schematic diagram illustrating the pixel array of the image display panel according to the first embodiment. As illustrated in FIGS. 2 and 4, in the image display panel 40, a pixel 48A (a first pixel) and a pixel 48B (a second pixel) adjacent to each other in the column direction configure a set of pixels 48 (pixel unit), and P×Q pixels 48 (pixel units) (P pixels in the row direction and Q pixels in the column direction) are arranged in the 2D matrix form. FIGS. 2 and 4 illustrate an example in which a plurality of pixels 48A and a plurality of pixels 48B are arranged in a 2D XY coordinate system so as to be arranged alternately in the row direction and the column direction, and thus are arranged in the matrix form. In this example, the row direction is the X direction, and the column direction is the Y direction. The row direction and the column direction are not limited to this example, the row direction may be the Y direction, and the column direction may be the X direction. The row direction and the column direction need not necessarily be the X direction and the Y direction that are orthogonal to each other in the 2D XY coordinate system as long as they are different directions.

In the first embodiment, the pixel 48A and the pixel 48B are arranged alternately in the X direction (the row direction) and the Y direction (the column direction). The arrangement of the pixel 48A and the pixel 48B is not limited to this example. For example, the pixel 48A and the pixel 48B are alternately arranged in the X direction, and the pixels 48A may be consecutively arranged in the Y direction, and the pixels 48B may be consecutively arranged in the Y direction. Alternatively, the pixels 48A and the pixel 48B are alternately arranged in the Y direction, whereas the pixels 48A may be consecutively arranged in the X direction, and the pixels 48B may be consecutively arranged in the X direction.

As illustrated in FIG. 4, the pixel 48A is a pixel array including three pixels, that is, a first sub pixel 49B, a second sub pixel 49W, and a third sub pixel 49G among the first sub pixel 49B, the second sub pixel 49W, the third sub pixel 49G, and a fourth sub pixel 49R. The pixel 48B is a pixel array including three pixels, that is, the first sub pixel 49B, the second sub pixel 49W, the fourth sub pixel 49R among the first sub pixel 49B, the second sub pixel 49W, the third sub pixel 49G, and the fourth sub pixel 49R.

As described above, the pixel 48 includes the first sub pixel 49B, the second sub pixel 49W, the third sub pixel 49G, and the fourth sub pixel 49R. The first sub pixel 49B displays the first color (blue as an original color in the first embodiment). The second sub pixel 49W displays the second color (white in the first embodiment). The third sub pixel 49G displays the third color (green as an original color in the first embodiment). The fourth sub pixel 49R displays the fourth color (red as an original color in the first embodiment). Hereinafter, when it is unnecessary to distinguish the first sub pixel 49B, the second sub pixel 49W, the third sub pixel 49G, and the fourth sub pixel 49R from one another, they are referred to as a "sub pixel 49". The image output unit 12 outputs RGB data that can be displayed by the first color, the third color, and the fourth color in the pixel 48 as the input signal of the signal processing unit 20. The first to fourth colors are not limited to this combination and may be different colors such as complementary colors, for example.

In the first embodiment, a so-called RG thinning configuration in which the pixel 48A does not include the fourth sub pixel 49R, and the pixel 48B does not include the third sub pixel 49G is employed, but the present disclosure is not limited to this example. For example, the pixel 48A may include the fourth sub pixel 49R, the third sub pixel 49G, and the first sub pixel 49B instead of the first sub pixel 49B, the second sub pixel 49W, and the third sub pixel 49G. The pixel 48B may include the fourth sub pixel 49R, the third sub pixel 49G, and the second sub pixel 49W instead of the first sub pixel 49B, the second sub pixel 49W, and the fourth sub pixel 49R. This configuration is a so-called BW thinning configuration. As described above, a combination of sub pixels is arbitrary as long as the pixel 48A includes three of four sub pixels, the pixel 48B includes three of four sub pixels, and one of the sub pixels of the pixel 48B is different from one of the sub pixels of the pixel 48A.

In the first embodiment, the first sub pixel 49B and the second sub pixel 49W have the same shape. The third sub pixel 49G and the fourth sub pixel 49R have the same shape. More specifically, the first sub pixel 49B, the second sub pixel 49W, the third sub pixel 49G, and the fourth sub pixel 49R have the same shape, that is, the rectangular shape. The first sub pixel 49B, the second sub pixel 49W, the third sub pixel 49G, and the fourth sub pixel 49R may be neither the same shape nor the rectangular shape. For example, the length of the third sub pixel 49G and the fourth sub pixel 49R in the Y direction may be larger than the length of the first sub pixel 49B and the second sub pixel 49W in the Y direction.

More specifically, the pixel 48A includes a pixel 48S (a third pixel) and a pixel 48T (a fourth pixel) as illustrated in FIG. 4. The pixel 48B includes a pixel 48U (a fifth pixel) and a pixel 48V (a sixth pixel). The pixel 48S is adjacent to the pixel 48U in the Y direction and adjacent to the pixel 48V in the X direction. The pixel 48T is adjacent to the pixel 48U in the X direction and adjacent to the pixel 48V in the Y direction. In other words, the pixel 48T is arranged at the position diagonal to the pixel 48S. In the first embodiment, the pixel 48S and the pixel 48U belong to the same pixel 48 (pixel unit), and the pixel 48T and the pixel 48V belong to the same pixel 48 (pixel unit).

The pixel 48S includes a first sub pixel 49SB serving as the first sub pixel 49B, a second sub pixel 49SW serving as the second sub pixel 49W, and a third sub pixel 49SG serving as the third sub pixel 49G. The pixel 48T includes a first sub pixel 49TB serving as the first sub pixel 49B, a second sub pixel 49TW serving as the second sub pixel 49W, and a third sub pixel 49TG serving as the third sub pixel 49G. The pixel 48U includes a first sub pixel 49UB serving as the first sub pixel 49B, a second sub pixel 49UW serving as the second sub pixel 49W, and a fourth sub pixel 49UR serving as the fourth sub pixel 49R. The pixel 48V includes a first sub pixel 49VB serving as the first sub pixel 49B, a second sub pixel 49VW serving as the second sub pixel 49W, and a fourth sub pixel 49VR serving as the fourth sub pixel 49R.

The sub pixels 49 are arranged in the X direction and the Y direction. As illustrated in FIG. 4, the sub pixels 49 are arranged along a first row extending in the X direction, a second row arranged as a row next to the first row, and a third row arranged as a row next to the second row. The sub pixels 49 are arranged along a first column extending in the Y direction, a second column arranged as a column next to the first column, a third column arranged as a column next to the second column, and a fourth column arranged as a column next to the third column. The first to third rows of the sub pixels 49 are periodically arranged in the Y direction and the first to fourth columns of the sub pixels 49 are periodically arranged in the X direction.

An array of the sub pixels 49 of the pixels 48S, 48T, 48U, and 48V will be described under the assumption that in a row and column in which a sub pixel is arranged, a sub pixel 49 arranged in an s-th row and a t-th column is indicated by a sub pixel 49(*s,t*). For example, since the first sub pixel 49SB of the pixel 48S is arranged in the first row and the first column, the first sub pixel 49SB is described as the first sub pixel 49SB(1,1). When it is unnecessary to describe an arrangement order of sub pixels, the sub pixel is described as the first sub pixel 49SB.

The pixel 48S (the third pixel) includes a first sub pixel 49SB(1,1), a second sub pixel 49SW(1,2), and a third sub pixel 49SG(2,1) as illustrated in FIG. 4. In other words, the first sub pixel 49SB(1,1) and the second sub pixel 49SW(1,2) are arranged in the same row, that is, the first row and adjacent in the X direction. The first sub pixel 49SB(1,1) and the third sub pixel 49SG(2,1) are adjacent in the Y direction.

The pixel 48U (the fifth pixel) includes a first sub pixel 49UB(3,1), a second sub pixel 49UW(3,2), and a fourth sub pixel 49UR(2,2). In other words, the first sub pixel 49UB(3,1) and the second sub pixel 49UW(3,2) are arranged in the same row, that is, the third row and adjacent in the X direction. The second sub pixel 49UW(3,2) and the fourth sub pixel 49UR(2,2) are adjacent in the Y direction. The fourth sub pixel 49UR(2,2) and the third sub pixel 49SG(2,1) of the pixel 48S are arranged in the same row, that is, the second row and adjacent in the X direction.

The pixel 48V (the sixth pixel) includes the first sub pixel 49VB(1,3), the second sub pixel 49VW(1,4), and the fourth sub pixel 49VR(2,4). In other words, the first sub pixel 49VB(1,3) and the second sub pixel 49VW(1,4) are arranged in the same row, that is, the first row and adjacent in the X direction. The second sub pixel 49VW(1,4) and the fourth sub pixel 49VR(2,4) are adjacent in the Y direction. The first sub pixel 49VB(1,3) is adjacent to the second sub pixel 49SW(1,2) of the pixel 48S in the X direction.

The pixel 48T (the fourth pixel) includes the first sub pixel 49TB(3,3), the second sub pixel 49TW(3,4), and the third sub pixel 49TG(2,3). In other words, the first sub pixel 49TB(3,3) and the second sub pixel 49TW(3,4) are arranged in the same row, that is, the third row and adjacent in the X direction. The first sub pixel 49TB(3,3) and the third sub pixel 49TG(2,3) are adjacent in the Y direction. The first sub pixel 49TB(3,3) is adjacent to the second sub pixel 49UW(3,2) of the pixel 48U in the X direction. The second sub pixel 49TW(3,4) is adjacent to the fourth sub pixel 49VR(2,4) of the pixel 48V in the Y direction. The third sub pixel 49TG(2,3) is arranged between the fourth sub pixel 49UR(2,2) of the pixel 48U and the fourth sub pixel 49VR(2,4) of the pixel 48V in the X direction, and arranged to be adjacent to the fourth sub pixel 49UR(2,2) of the pixel 48U and the fourth sub pixel 49VR(2,4) of the pixel 48V in the X direction. The third sub pixel 49TG(2,3) is adjacent to the first sub pixel 49VB(1,3) of the pixel 48V in the Y direction.

As described above, in the image display panel 40, the third sub pixel 49G and the fourth sub pixel 49R are adjacent to each other in the X direction. The third sub pixel 49G and the fourth sub pixel 49R need not necessarily be adjacent to each other when the third sub pixel 49G and the fourth sub pixel 49R overlap in the Y direction at least partially.

Each of the sub pixels 49 arranged as described above is coupled to one of scanning lines SCL1 and SCL2 extending in the X direction and one of signal lines DTL1, DTL2, DTL3, DTL4, DTL5, and DTL6 extending in the Y direction via a switching element Tr.

The scanning line SCL1 is coupled to the first sub pixel 49SB(1,1), the second sub pixel 49SW(1,2), and the third sub pixel 49SG(2,1) of the pixel 48S as illustrated in FIG. 4. The scanning line SCL1 is coupled to the first sub pixel 49VB(1,3), the second sub pixel 49VW(1,4), and the fourth sub pixel 49VR(2,4) of the pixel 48V.

The scanning line SCL2 is coupled to the first sub pixel 49UB(3,1), the second sub pixel 49UW(3,2), and the fourth sub pixel 49UR(2,2) of the pixel 48U. The scanning line SCL2 is coupled to the first sub pixel 49TB(3,3), the second sub pixel 49TW(3,4), and the third sub pixel 49TG(2,3) of the pixel 48T. In other words, in the first embodiment, it is possible to drive one pixel through control of one scanning line SCL.

The signal line DTL1 is coupled with the first sub pixel 49SB(1,1) of the pixel 48S and the first sub pixel 49UB(3,1) of the pixel 48U. The signal line DTL2 is coupled with the third sub pixel 49SG(2,1) of the pixel 48S and the fourth sub pixel 49UR(2,2) of the pixel 48U. The signal line DTL3 is coupled with the second sub pixel 49SW(1,2) of the pixel 48S and the second sub pixel 49UW(3,2) of the pixel 48U. The signal line DTL4 is coupled with the first sub pixel 49VB(1,3) of the pixel 48V and the first sub pixel 49TB(3,3) of the pixel 48T.

The signal line DTL5 is coupled to the fourth sub pixel 49VR(2,4) of the pixel 48V, the third sub pixel 49TG(2,3) of the pixel 48T. The signal line DTL6 is coupled to the second sub pixel 49VW(1,4) of the pixel 48V, the second sub pixel 49TW(3,4) of the pixel 48T.

The scanning line SCL and the signal line DTL are coupled to the respective sub pixels 49 as described above, but the connection of the scanning line SCL and the signal line DTL is not limited to this example and can be arbitrarily selected.

Meanwhile, the input signal output from the image output unit 12 of the control device 11 has color information for displaying a color of one of divided regions (pixel display regions) when an image of one frame is divided in a 2D matrix form. Color information of an image of one frame is collected by a plurality of input signals having color information of different pixel display regions. Thus, an image of one frame can be displayed. In other words, a region of the image display panel 40 in which an image is displayed is divided in a 2D matrix form in units of pixel display regions serving as regions in which colors are displayed based on color information of respective input signals. Further, a plurality of input signals are input, and all pieces of color information of the region of the image display panel 40 in which an image is displayed are collected. Thus, the region of the image display panel 40 in which an image is displayed can display an image of one frame.

As illustrated in FIG. 4, the pixel display regions for dividing the region of the image display panel 40 in which an image is displayed include a pixel display region 50A (a first pixel display region) and a pixel display region 50B (a second pixel display region) adjacent to the pixel display region 50A. In the first embodiment, the pixel display region 50A and the pixel display region 50B are adjacent in the Y direction. The pixel display region 50A and the pixel display region 50B have the same shape, that is, the rectangular shape. The shape of the pixel display region 50A and the pixel display region 50B is not limited to this example and arbitrary, and the pixel display region 50A and the pixel display region 50B may have different shapes.

More specifically, the pixel display region 50A includes a pixel display region 50S (a third pixel display region) and a pixel display region 50T (a fourth pixel display region) as illustrated in FIG. 4. The pixel display region 50B includes a pixel display region 50U (a fifth pixel display region) and a pixel display region 50V (a sixth pixel display region). The pixel display region 50S is adjacent to the pixel display region 50U in the Y direction and adjacent to the pixel display region 50V in the X direction. The pixel display region 50T is adjacent to the pixel display region 50U in the X direction and adjacent to the pixel display region 50V in the Y direction. In other words, the pixel display region 50T is positioned on the diagonal line to the pixel display region 50S.

As illustrated in FIG. 4, a region in which the first sub pixel 49SB(1,1) and the second sub pixel 49SW(1,2) of the pixel 48S are arranged, a region of one part of the third sub pixel 49SG(2,1) of the pixel 48S, and a region of one part of the fourth sub pixel 49UR(2,2) of the pixel 48U are arranged in the pixel display region 50S. More specifically, the region of the part of the third sub pixel 49SG(2,1) of the pixel 48S is a first row side region of regions obtained by dividing the third sub pixel 49SG(2,1) of the pixel 48S into two in the Y direction. The region of the part of the fourth sub pixel 49UR(2,2) of the pixel 48U is a first row side region of regions obtained by dividing the fourth sub pixel 49UR(2,2) of the pixel 48U into two in the Y direction.

A region in which the first sub pixel 49TB(3,3) and the second sub pixel 49TW(3,4) of the pixel 48T are arranged, a region of one part of the third sub pixel 49TG(2,3) of the pixel 48T, and a region of one part of the fourth sub pixel 49VR(2,4) of the pixel 48V are arranged in the pixel display region 50T. More specifically, the region of the part of the third sub pixel 49TG(2,3) of the pixel 48T is a third row side region of regions obtained by dividing the third sub pixel 49TG(2,3) of the pixel 48T into two in the Y direction. The region of the part of the fourth sub pixel 49VR(2,4) of the pixel 48V is a third row side region of regions obtained by dividing the fourth sub pixel 49VR(2,4) of the pixel 48V into two in the Y direction.

A region in which the first sub pixel 49UB(3,1) and the second sub pixel 49UW(3,2) of the pixel 48U are arranged, a region of the other part of the third sub pixel 49SG(2,1) of the pixel 48S, and a region of the other part of the fourth sub pixel 49UR(2,2) of the pixel 48U are arranged in the pixel display region 50U. More specifically, the region of the other part of the third sub pixel 49SG(2,1) of the pixel 48S is a third row side region of regions obtained by dividing the third sub pixel 49SG(2,1) of the pixel 48S into two in the Y direction. The region of the other part of the fourth sub pixel 49UR(2,2) of the pixel 48U is a third row side region of regions obtained by dividing the fourth sub pixel 49UR(2,2) of the pixel 48U into two in the Y direction.

A region in which the first sub pixel 49VB(1,3) and the second sub pixel 49VW(1,4) of the pixel 48V are arranged, a region of the other part of the third sub pixel 49TG(2,3) of the pixel 48T, and a region of the other part of the fourth sub pixel 49VR(2,4) of the pixel 48V are arranged in the pixel display region 50V. More specifically, the region of the other part of the third sub pixel 49TG(2,3) of the pixel 48T is a first row side region of regions obtained by dividing the third sub pixel 49TG(2,3) of the pixel 48T into two in the Y direction. The region of the other part of the fourth sub pixel 49VR(2,4) of the pixel 48V is a first row side region of regions obtained by dividing the fourth sub pixel 49VR(2,4) of the pixel 48V into two in the Y direction.

A relation between the regions of the sub pixels 49 and the pixel display regions can be represented as follows. The region of the first sub pixel 49B and the second sub pixel 49W of the pixel 48A, the region of one part of the third sub pixel 49G, and the region of one part of the fourth sub pixel 49R are arranged in the pixel display region 50A. The region of the first sub pixel 49B and the second sub pixel 49W of the pixel 48B, the region of the other part of the third sub pixel 49G of the pixel 48A, and the region of the other part of the fourth sub pixel 49R of the pixel 48B are arranged in the pixel display region 50B.

More specifically, for the third sub pixel 49G and the fourth sub pixel 49R, a previous row side region of the two regions divided in the Y direction is arranged in the pixel display region 50A, and a next row side region of the two regions divided in the Y direction is arranged in the pixel display region 50B. In the third sub pixel 49G, the divided two regions preferably have the same area, and the divided two regions preferably have the same shape. Similarly, in the fourth sub pixel 49R, the divided two regions preferably have the same area, and the divided two regions preferably have the same shape. A method of dividing the third sub pixel 49G and the fourth sub pixel 49R is arbitrary, and one part and the other part of each of the third sub pixel 49G and the fourth sub pixel 49R are preferably arranged in different pixel display regions.

In other words, in the pixel 48A, one part of the third sub pixel 49G extends in the pixel display region 50B that is opposite to the pixel 48A in the Y direction. For example, one part at the third row side of two parts obtained by dividing the third sub pixel 49SG(2,1) of the pixel 48S of the pixel 48A into two in the Y direction extends in the pixel display region 50U. In the pixel 48B, one part of the fourth sub pixel 49R extends in the pixel display region 50A that is opposite in the Y direction. For example, one part at the first row side of two parts obtained by dividing the fourth sub pixel 49UR(2,2) of the pixel 48U of the pixel 48B into two in the Y direction extends in the pixel display region 50S.

Figure 5:
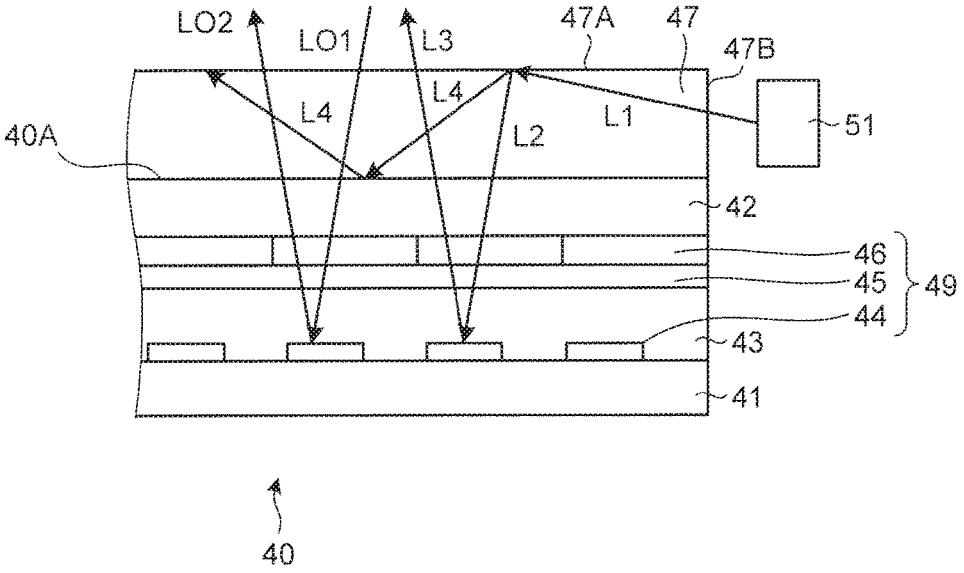
FIG. 5 is a cross-sectional view schematically illustrating a structure of the image display panel according to the first embodiment.

Next, a structure of the image display panel 40 will be described. In the first embodiment, the image display panel 40 is a reflective image display panel. FIG. 5 is a cross-sectional view schematically illustrating a structure of the image display panel according to the first embodiment. The image display panel 40 includes an array substrate 41, a counter substrate 42 which is opposite to the array substrate 41, and a liquid crystal layer 43 in which a liquid crystal element is sealed between the array substrate 41 and the counter substrate 42 as illustrated in FIG. 5.

A plurality of pixel electrodes 44 are provided on a liquid crystal layer 43 side surface of the array substrate 41. The pixel electrode 44 is coupled to the signal line DTL via a switching element, and an image output signal serving as a video signal is applied to the pixel electrode 44. The pixel electrode 44 is a member having reflectivity made of, for example, aluminum or silver, and reflects ambient light or light emitted from the light source unit 51. In other words, in the first embodiment, the pixel electrode 44 configures a reflecting unit, and the reflecting unit reflects light incident from the front surface (the surface at the side at which an image is displayed) of the image display panel 40 so that an image is displayed.

The counter substrate 42 is a substrate having transparency such as glass or the like. A counter electrode 45 and a color filter 46 are provided on a liquid crystal layer 43 side surface of the counter substrate 42. More specifically, the counter electrode 45 is provided on a liquid crystal layer 43 side surface of the color filter 46.

For example, the counter electrode 45 is a conductive material having transparency such as indium tin oxide (ITO) or indium zinc oxide (IZO). The counter electrode 45 is coupled with the switching element to which the pixel electrode 44 is coupled. Since the pixel electrode 44 and the counter electrode 45 are formed to be opposite to each other, when a voltage of the image output signal is applied to between the pixel electrode 44 and the counter electrode 45, the pixel electrode 44 and the counter electrode 45 cause the electric field to be generated in the liquid crystal layer 43. The electric field generated in the liquid crystal layer 43 twists the liquid crystal element and changes birefringence thereof, and thus the display device 10 adjust a quantity of light reflected from the image display panel 40. The image display panel 40 employs a so-called vertical electric field scheme but may employ a horizontal electric field scheme in which the electric field is generated in a direction parallel to the display surface of the image display panel 40.

A plurality of color filters 46 are disposed in a manner corresponding to the pixel electrodes 44. The pixel electrode 44, the counter electrode 45, and the color filter 46 configure the sub pixel 49. For the color filter 46, a first color filter that is disposed in the first sub pixel 49B and passes the first color to an image observer, a second color filter that is disposed in the third sub pixel 49G and passes the third color to the image observer, and a third color filter that is disposed in the fourth sub pixel 49R and passes the fourth color to the image observer are arranged. In the image display panel 40, no color filter is arranged for the second sub pixel 49W. The second sub pixel 49W may be provided with a transparent resin layer instead of a color filter. As described above, the image display panel 40 provided with the transparent resin layer can suppress the occurrence of a large gap above the second sub pixel 49W, otherwise a large gap occurs because no color filter is arranged for the second sub pixel 49W.

A light guide plate 47 is disposed on a surface of the counter substrate 42 that is opposite to the liquid crystal layer 43 side surface. For example, the light guide plate 47 is a flat-like member having transparency made of acrylic resin, polycarbonate (PC) resin, methyl methacrylate-styrene copolymer (MS resin), or the like. The light guide plate 47 has a top surface 47A opposite to a counter substrate 42 side surface, and the top surface 47A has undergone a prism process.

Configuration of Light Source Unit

The light source unit 51 is an LED in the first embodiment. The light source unit 51 is disposed along a side surface 47B of the light guide plate 47 as illustrated in FIG. 5. The light source unit 51 emits light to the image display panel 40 from the front surface of the image display panel 40 through the light guide plate 47. The light source unit 51 is switched between the ON and OFF states according to an operation performed by the image observer or an ambient light sensor that is attached to the display device 10 to measure ambient light. The light source unit 51 emits light in the ON state but does not emit light in the OFF state. For example, when the image observer feels that an image is dark, the image observer turns on the light source unit 51, and thus light is emitted from the light source unit 51 to the image display panel 40, and the image becomes bright. When the ambient light sensor determines that the intensity of ambient light is smaller than a certain value, for example, the signal processing unit 20 turns on the light source unit 51, and thus light is emitted from the light source unit 51 to the image display panel 40, and the image becomes bright. In the first embodiment, the signal processing unit 20 does not control luminance of light of the light source unit 51 according to the expansion coefficient $\alpha$. In other words, the luminance of the light of the light source unit 51 is set regardless of the expansion coefficient $\alpha$ which will be described later. The luminance of the light of the light source unit 51 may be adjusted according to an operation performed by the image observer or a measurement result of the ambient light sensor.

Next, reflection of light by the image display panel 40 will be described. Ambient light LO1 is incident on the image display panel 40 as illustrated in FIG. 5. The ambient light LO1 is incident on the pixel electrode 44 through the light guide plate 47 and the image display panel 40. The ambient light LO1 incident on the pixel electrode 44 is reflected by the pixel electrode 44 and then exits to the outside through the image display panel 40 and the light guide plate 47 as light LO2. When the light source unit 51 is turned on, light L1 emitted from the light source unit 51 is incident on the light guide plate 47 from the side surface 47B of the light guide plate 47. The light L1 incident into the light guide plate 47 is scattered and reflected by the top surface 47A of the light guide plate 47, and a part of the light L1 is incident into the image display panel 40 from the counter substrate 42 side of the image display panel 40 and irradiated to the pixel electrode 44 as light L2. The light L2 irradiated to the pixel electrode 44 is reflected by the pixel electrode 44 and exits to the outside through the image display panel 40 and the light guide plate 47 as light L3. Another part of the light scattered by the top surface 47A of the light guide plate 47 is reflected as light L4 and repeatedly reflected in the light guide plate 47.

In other words, the pixel electrode 44 reflects the ambient light LO1 or the light L2 incident on the image display panel 40 from the front surface serving as the outside side (the counter substrate 42 side) surface of the image display panel 40 toward the outside. The light LO2 and L3 reflected toward the outside pass through the liquid crystal layer 43 and the color filter 46. Thus, the display device 10 can display an image with the light LO2 and L3 reflected toward the outside. As described above, the display device 10 according to the first embodiment is a reflective display device of a front light type including the light source unit 51 of an edge light type. In the first embodiment, the display device 10 includes the light source unit 51 and the light guide plate 47 but may not include the light source unit 51 and the light guide plate 47. In this case, the display device 10 can display an image with the light LO2 generated by reflection of the ambient light LO1.

Processing Operation of Display Device

Figure 6:
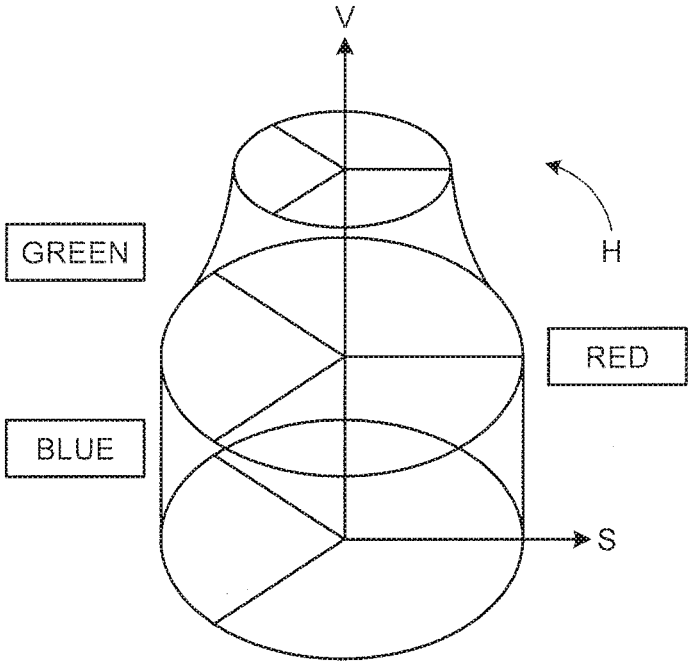
FIG. 6 is a conceptual diagram of an extended HSV color space that is extendable by the display device according to the present embodiment.
Figure 7:
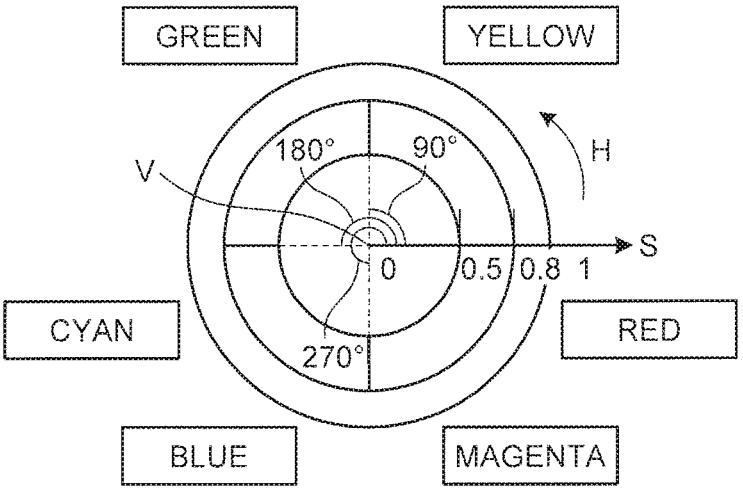
FIG. 7 is a conceptual diagram illustrating a relation between a hue and a saturation of an extended HSV color space.

FIG. 6 is a conceptual diagram of an extended HSV color space that is extendable by the display device according to the present embodiment. FIG. 7 is a conceptual diagram illustrating a relation between a hue and a saturation of the extended HSV color space. The signal processing unit 20 receives an input signal serving as information of an image to be displayed from the outside. The input signal includes information of an image (color) to be displayed at a corresponding position for each pixel as an input signal. Specifically, in the image display panel 40 in which P×Q pixels 48 (pixel units) are arranged in a matrix form, for the pixel 48A of a (p,q)-th pixel 48 (here, $1 \le p \le P$, $1 \le q \le Q$), a signal including an input signal of the first sub pixel 49B whose signal value is $x_{1A-(p,q)}$, an input signal of the third sub pixel 49G whose signal value is $x_{3A-(p,q)}$, and an input signal of the fourth sub pixel 49R whose signal value is $x_{4A-(p,q)}$ (see FIG. 1) is input to the signal processing unit 20. Similarly, for the pixel 48B of the (p,q)-th pixel 48 (here, $1 \le p \le P$, $1 \le q \le Q$), a signal including an input signal of the first sub pixel 49B whose signal value is $x_{1B-(p,q)}$, an input signal of the third sub pixel 49G whose signal value is $x_{3B-(p,q)}$, and an input signal of the fourth sub pixel 49R whose signal value is $x_{4B-(p,q)}$ (see FIG. 1) is input to the signal processing unit 20.

The signal processing unit 20 illustrated in FIG. 1 processes the input signals, generates an output signal (a signal value $X_{1A-(p,q)}$) of the first sub pixel for deciding a display gradation of the first sub pixel 49B of the pixel 48A, an output signal (a signal value $X_{3A-(p,q)}$) of the third sub pixel for deciding a display gradation of the third sub pixel 49G, an output signal (a signal value $X_{4A-(p,q)}$) of the fourth sub pixel for deciding a display gradation of the fourth sub pixel 49R, and an output signal (a signal value $X_{2A-(p,q)}$) of the second sub pixel for deciding a display gradation of the second sub pixel 49W, and outputs the output signals to the image-display-panel driving unit 30. Similarly, the signal processing unit 20 generates an output signal (a signal value $X_{1B-(p,q)}$) of the first sub pixel for deciding a display gradation of the first sub pixel 49B of the pixel 48B, an output signal (a signal value $X_{3B-(p,q)}$) of the third sub pixel for deciding the display gradation of the third sub pixel 49G, an output signal (a signal value $X_{4B-(p,q)}$) of the fourth sub pixel for deciding the display gradation of the fourth sub pixel 49R, and an output signal (a signal value $X_{2B-(p,q)}$) of the second sub pixel for deciding the display gradation of the second sub pixel 49W, and outputs the output signals to the image-display-panel driving unit 30. Hereinafter, when it is unnecessary to distinguish the input signal of the pixel 48A from the input signal of the pixel 48B, for example, $x_{1A-(p,q)}$ and $x_{1B-(p,q)}$ are referred to appropriately as "$x_{1-(p,q)}$". When it is unnecessary to distinguish the output signal of the pixel 48A from the output signal of the pixel 48B, for example, $X_{1A-(p,q)}$ and $X_{1B-(p,q)}$ are referred to appropriately as "$X_{1-(p,q)}$".

In the display device 10, the pixel 48 includes the second sub pixel 49W that outputs a second color component (for example, white), and thus it is possible to widen the dynamic range of brightness in the HSV color space (the extended HSV color space) as illustrated in FIG. 6. In other words, as illustrated in FIG. 6, a three-dimensional shape having a substantially truncated cone shape in which a maximum value of a brightness V decreases as a saturation S increases is place on a HSV color space of a circular cylindrical shape that can be displayed on the first sub pixel 49B, the third sub pixel 49G, and the fourth sub pixel 49R.

The signal processing unit 20 stores the maximum value Vmax(S) of the brightness with the saturation S as a variable in the HSV color space extended by adding the second color component (for example, white) in the signal processing unit 20. In other words, the signal processing unit 20 stores the value of the maximum value Vmax(S) of the brightness for each coordinates (coordinate values) of the saturation and the hue for the three-dimensional shape of the HSV color space illustrated in FIG. 6. Since the input signal includes the input signals of the first sub pixel 49B, the third sub pixel 49G, and the fourth sub pixel 49R, the HSV color space of the input signal has the same shape as the circular cylindrical shape, that is, the circular cylindrical shaped portion of the extended HSV color space.

Then, the signal processing unit 20 calculates an output signal (a signal value $X_{1-(p,q)}$) of the first sub pixel 49B based on at least an input signal (a signal value $x_{1-(p,q)}$) of the first sub pixel 49B and the expansion coefficient α, and outputs the calculated output signal to the first sub pixel 49B. The signal processing unit 20 calculates an output signal (a signal value $X_{3-(p,q)}$) of the third sub pixel 49G based on at least an input signal (a signal value $x_{3-(p,q)}$) of the third sub pixel 49G and the expansion coefficient α, and outputs the calculated output signal to the third sub pixel 49G. The signal processing unit 20 calculates an output signal (a signal value $X_{4-(p,q)}$) of the fourth sub pixel 49R based on at least an input signal (a signal value $x_{4-(p,q)}$) of the fourth sub pixel 49R and the expansion coefficient α, and outputs the calculated output signal to the fourth sub pixel 49R. Further, the signal processing unit 20 calculates an output signal (a signal value $X_{2-(p,q)}$) of the second sub pixel 49W based on the input signal (the signal value $x_{1-(p,q)}$) of the first sub pixel 49B, the input signal (the signal value $x_{3-(p,q)}$) of the third sub pixel 49G, and the input signal (the signal value $x_{4-(p,q)}$) of the fourth sub pixel 49R, and outputs the calculated output signal to the second sub pixel 49W.

Specifically, the signal processing unit 20 calculates the output signal of the first sub pixel 49B based on the input signal of the first sub pixel 49B, the expansion coefficient α, and the output signal of the second sub pixel 49W, calculates the output signal of the third sub pixel 49G based on the input signal of the third sub pixel 49G, the expansion coefficient α, and the output signal of the second sub pixel 49W, and calculates the output signal of the fourth sub pixel 49R based on the input signal of the fourth sub pixel 49R, the expansion coefficient α, and the output signal of the second sub pixel 49W.

In other words, when χ is a constant depending on the display device 10, the signal processing unit 20 obtains the signal value $X_{1-(p,q)}$ serving as the output signal of the first sub pixel 49B, the signal value $X_{3-(p,q)}$ serving as the output signal of the third sub pixel 49G, and the signal value $X_{4-(p,q)}$ of the output signal of the fourth sub pixel 49R for the (p,q)-th pixel (a set of the first sub pixel 49B, the third sub pixel 49G, and the fourth sub pixel 49R) using the following Formulas (1) to (3):

$$X_{1-(p,q)} = \alpha \cdot x_{1-(p,q)} - \chi \cdot X_{2-(p,q)} \tag{1}$$

$$X_{3-(p,q)} = \alpha \cdot x_{3-(p,q)} - \chi \cdot X_{2-(p,q)} \tag{2}$$

$$X_{4-(p,q)} = \alpha \cdot x_{4-(p,q)} - \chi \cdot X_{2-(p,q)} \tag{3}$$

More specifically, the signal processing unit 20 obtains an output signal value $X_{1A-(p,q)}$ of the first sub pixel 49B in the pixel 48A of the (p,q)-th pixel 48 using the following Formula (1-1), and obtains an output signal value $X_{3A-(p,q)}$ of the third sub pixel 49G using the following Formula (2-1).

$$X_{1A-(p,q)} = \alpha \cdot x_{1A-(p,q)} - \chi \cdot X_{2A-(p,q)} \tag{1-1}$$

$$X_{3A-(p,q)} = \alpha \cdot x_{3A-(p,q)} - \chi \cdot X_{2A-(p,q)} \tag{2-1}$$

The signal processing unit 20 obtains an output signal value $X_{1B-(p,q)}$ of the first sub pixel 49B in the pixel 48B of the (p,q)-th pixel 48 using the following Formula (1-2), and obtains an output signal value $X_{4B-(p,q)}$ of the fourth sub pixel 49R using the following Formula (3-1).

$$X_{1B-(p,q)}=\alpha x_{1B-(p,q)}-\chi X_{2B-(p,q)} \quad (1\text{-}2)$$

$$X_{4B-(p,q)}=\alpha x_{4B-(p,q)}-\chi X_{2B-(p,q)} \quad (3\text{-}1)$$

The signal processing unit 20 obtains the maximum value Vmax(S) of the brightness in which the saturation S in the HSV color space extended by adding the fourth color is a variable, obtains the saturation S and the brightness V(S) of a plurality of pixels based on the input signal values of the sub pixels in the plurality of pixel, and decides the expansion coefficient α so that the ratio of pixels in which a value of extended brightness obtained from the product of the brightness V(S) and the expansion coefficient α exceeds the maximum value Vmax(S) to all the pixels is a limit value β or less. The limit value β is an upper limit value (upper limit ratio) of the ratio of the range exceeding the maximum value of the brightness of the extended HSV color space in a combination of values of the hue and the saturation to the maximum value.

The saturation S and the brightness V(S) is represented by S=(Max−Min)/Max and V(S)=Max, respectively. The saturation S takes a value of 0 to 1, the brightness V(S) takes a value of 0 to $(2^n-1)$, and n is a display gradation bit number. Max is a maximum value of the input signal values of the three sub pixels, that is, the input signal value of the first sub pixel, the input signal value of the third sub pixel and the input signal value of the fourth sub pixel for the pixel. Min is a minimum value of the input signal values of the three sub pixels, that is, the input signal value of the first sub pixel, the input signal value of the third sub pixel and the input signal value of the fourth sub pixel for the pixel. The hue H is indicated by 0° to 360° as illustrated in FIG. 7. As it increases from 0° to 360°, it indicates red, yellow, green, cyan, blue, magenta, and red. In the present embodiment, a region including an angle 0° is red, a region including an angle 120° is green, and a region including an angle 240° is blue.

In the present embodiment, an output signal value $X_{2-(p,q)}$ of the second sub pixel 49W can be obtained based on the product of $Min_{(p,q)}$ and the expansion coefficient α. Specifically, the signal value $X_{2-(p,q)}$ can be obtained based on the following Formula (4). In Formula (4), the product of $Min_{(p,q)}$ and the expansion coefficient α is divided by χ, but the present disclosure is not limited to this example. χ will be described later. The expansion coefficient α is decided for each image display frame.

$$X_{2-(p,q)}=Min_{(p,q)}\cdot\alpha/\chi \quad (4)$$

More specifically, the signal processing unit 20 obtains an output signal value $X_{2A-(p,q)}$ of the second sub pixel 49W in the pixel 48A of the (p,q)-th pixel 48 using the following Formula (4-1), and obtains an output signal value $X_{2B-(p,q)}$ of the second sub pixel 49W in the pixel 48B of the (p,q)-th pixel 48 using the following Formula (4-2).

$$X_{2A-(p,q)}=Min_{A(p,q)}\cdot\alpha/\chi \quad (4\text{-}1)$$

$$X_{2B-(p,q)}=Min_{B(p,q)}\cdot\alpha/\chi \quad (4\text{-}2)$$

$Min_{A(p,q)}$ is a minimum value of the input signal values of the three sub pixels 49 of $(x_{1A-(p,q)}, x_{3A-(p,q)}, x_{4A-(p,q)})$. $Min_{B(p,q)}$ is a minimum value of the input signal values of the three sub pixels 49 of $(x_{1B-(p,q)}, x_{3B-(p,q)}, x_{4B-(p,q)})$.

Generally, the saturation $S_{(p,q)}$ and the brightness $V(S)_{(p,q)}$ in the circular cylindrical HSV color space can be obtained based on the input signal (the signal value $x_{1-(p,q)}$) of the first sub pixel 49B, the input signal (the signal value $x_{3-(p,q)}$) of the third sub pixel 49G, and the input signal (the signal value $x_{4-(p,q)}$) of the fourth sub pixel 49R of the (p,q)-th pixel using the following Formulas (5) and (6).

$$S_{(p,q)}=(Max_{(p,q)}-Min_{(p,q)})/Max_{(p,q)} \quad (5)$$

$$V(S)_{(p,q)}=Max_{(p,q)} \quad (6)$$

Here, $Max_{(p,q)}$ is a maximum value of the input signal values of the three sub pixels 49 of $(x_{1-(p,q)}, x_{3-(p,q)}, x_{4-(p,q)})$, and $Min_{(p,q)}$ is a minimum value of the input signal values of the three sub pixels 49 of $(x_{1-(p,q)}, x_{3-(p,q)}, x_{4-(p,q)})$. In the present embodiment, n=8 is assumed. In other words, the display gradation bit number is assumed to be 8 (the display gradation has a value of 256 gradations of 0 to 255).

No color filter is arranged for the second sub pixel 49W displaying white. When a signal having a value corresponding to the maximum signal value of the output signal of the first sub pixel is input to the first sub pixel 49B, a signal having a value corresponding to the maximum signal value of the output signal of the third sub pixel is input to the third sub pixel 49G, and a signal having a value corresponding to the maximum signal value of the output signal of the fourth sub pixel is input to the fourth sub pixel 49R, luminance of an aggregate of the first sub pixel 49B, the third sub pixel 49G and the fourth sub pixel 49R included in the pixel 48 or a group of the pixels 48 is assumed to be $BN_{134}$. When a signal having a value corresponding to the maximum signal value of the output signal of the second sub pixel 49W is input to the second sub pixel 49W included in the pixel 48 or a group of the pixels 48, luminance of the second sub pixel 49W is assumed to be $BN_2$. In other words, white of the maximum luminance is displayed by an aggregate of the first sub pixel 49B, the third sub pixel 49G, and the fourth sub pixel 49R, and luminance of white is indicated by $BN_{134}$. In this case, when χ is a constant depending on the display device 10, a constant χ is indicated by $\chi=BN_2/BN_{134}$.

Specifically, the luminance $BN_2$ when the input signal having the value 255 of the display gradation is assumed to be input to the second sub pixel 49W is, for example, 1.5 times as high as the luminance $BN_{134}$ of white when the signal value $x_{1-(p,q)}$ (=255), the signal value $x_{3-(p,q)}$ (=255), and the signal value $x_{4-(p,q)}$ (=255) are input to the aggregate of the first sub pixel 49B, the third sub pixel 49G, and the fourth sub pixel 49R as input signals having the above values of the display gradation, respectively. In other words, in the present embodiment, χ=1.5.

Meanwhile, when the signal value $X_{2-(p,q)}$ is given by Formula (4), Vmax(S) can be represented as in the following Formulas (7) and (8).

when $S \le S_0$, $$V\max(S)=(\chi+1)\cdot(2^n-1) \quad (7)$$

when $S_0 < S \le 1$, $$V\max(S)=(2^n-1)\cdot(1/S) \quad (8)$$

Here, $S_0=1/(\chi+1)$.

For example, the signal processing unit 20 stores the maximum value Vmax(S) of the brightness in which the saturation S in the HSV color space extended by adding the second color is a variable, which is obtained as described above, as a sort of lookup table. Alternatively, the maximum value Vmax(S) of the brightness in which the saturation S in the extended HSV color space is a variable is obtained by the signal processing unit 20 each time.

Next, a method of obtaining the signal values $X_{1A-(p,q)}$, $X_{2A-(p,q)}$, $X_{3A-(p,q)}$, and $X_{4A-(p,q)}$ serving as the output signal for the pixel 48A of the (p,q)-th pixel 48 and a method of obtaining the signal values $X_{1B-(p,q)}$, $X_{2B-(p,q)}$, $X_{3B-(p,q)}$, and $X_{4B-(p,q)}$ serving as the output signal for the pixel 48B of the (p,q)-th pixel 48 (the expansion process) will be described. The following process is performed such that the ratio of the luminance of the first color (original color) displayed by (the first sub pixel 49B+the second sub pixel 49W), the luminance of the third color (original color) displayed by (the third sub pixel 49G+the second sub pixel 49W), and the luminance of the fourth color (original color) displayed by (the fourth sub pixel 49R+the second sub pixel 49W) is maintained. In addition, the following process is performed such that a color tone is held (maintained). Moreover, the following process is performed such that gradation-luminance characteristic (a gamma characteristic, a γ characteristic) is held (maintained).

First Process

First, the signal processing unit 20 obtains the saturation S and the brightness V(S) of a plurality of pixels 48A and a plurality of pixels 48B based on the input signal values of the sub pixels 49 of a plurality of pixels 48A and a plurality of pixels 48B. Specifically, $S_{(p,q)}$ and $V(S)_{(p,q)}$ are obtained based on the signal value $x_{1A-(p,q)}$ serving as the input signal of the first sub pixel 49B of the pixel 48A of the (p,q)-th pixel 48, the signal value $x_{3A-(p,q)}$ serving as the input signal of the third sub pixel 49G, and the signal value $x_{4A-(p,q)}$ serving as the input signal of the fourth sub pixel 49R using Formulas (5) and (6). Similarly, $S_{(p,q)}$ and $V(S)_{(p,q)}$ are obtained based on the signal value $x_{1B-(p,q)}$ serving as the input signal of the first sub pixel 49B of the pixel 48B of the (p,q)-th pixel 48, the signal value $x_{3B-(p,q)}$ serving as the input signal of the third sub pixel 49G, and the signal value $x_{4B-(p,q)}$ serving as the input signal of the fourth sub pixel 49R using Formulas (5) and (6). The signal processing unit 20 performs this process on all the pixels 48A and the pixels 48B.

Second Process

Then, the signal processing unit 20 obtains the expansion coefficient α(S) based on Vmax(S)/V(S) obtained with respect to a plurality of pixels 48 using Formula (10).

$$\alpha(S)=V\max(S)/V(S) \tag{10}$$

Third Process

Then, the signal processing unit 20 obtains the signal value $X_{2A-(p,q)}$ for the pixel 48A of the (p,q)-th pixel 48 based on at least the signal value $x_{1A-(p,q)}$, the signal value $x_{3A-(p,q)}$, and the signal value $x_{4A-(p,q)}$ of the input signals. In the present embodiment, the signal processing unit 20 decides the signal value $X_{2A-(p,q)}$ based on $\mathrm{Min}_{(p,q)}$, the expansion coefficient α, and the constant χ. More specifically, the signal processing unit 20 obtains the signal value $X_{2A-(p,q)}$ based on Formula (4) as described above. Similarly, the signal processing unit 20 obtains the signal value $X_{2B-(p,q)}$ for the pixel 48B of the (p,q)-th pixel 48 using Formula (4). The signal processing unit 20 obtains the signal values $X_{2A-(p,q)}$ and $X_{2B-(p,q)}$ for the pixels 48A and 48B of all $P_0 \times Q_0$ pixels 48.

Fourth Process

Thereafter, the signal processing unit 20 obtains the signal value $X_{1A-(p,q)}$ for the pixel 48A of the (p,q)-th pixel 48 based on the signal value $x_{1A-(p,q)}$, the expansion coefficient α, and the signal value $X_{2A-(p,q)}$, obtains the signal value $X_{3A-(p,q)}$ based on the signal value $x_{3A-(p,q)}$, the expansion coefficient α, and the signal value $X_{2A-(p,q)}$, and obtains the signal value $X_{4A-(p,q)}$ based on the signal value $x_{4A-(p,q)}$ the expansion coefficient α, and the signal value $X_{2A-(p,q)}$. Specifically, the signal processing unit 20 obtains the signal value $X_{1A-(p,q)}$, the signal value $X_{3A-(p,q)}$, and the signal value $X_{4A-(p,q)}$ for the pixel 48A of the (p,q)-th pixel 48 using Formulas (1) to (3). Similarly, the signal processing unit 20 obtains the output signal value $X_{1B-(p,q)}$ for the pixel 48B of the (p,q)-th pixel 48 based on the input signal value $x_{1B-(p,q)}$, the expansion coefficient α, and the output signal value $X_{2B-(p,q)}$, obtains the output signal value $X_{3B-(p,q)}$ based on the input signal value $x_{3B-(p,q)}$, the expansion coefficient α, and the output signal value $X_{2B-(p,q)}$, and obtains the output signal value $X_{4B-(p,q)}$ based on the input signal value $X_{4B-(p,q)}$, the expansion coefficient α, and the output signal value $X_{2B-(p,q)}$. The signal processing unit 20 obtains the signal value $X_{1B-(p,q)}$, the signal value $X_{3B-(p,q)}$, and the signal value $X_{4B-(p,q)}$ for the pixel 48B of the (p,q)-th pixel 48 using Formulas (1) to (3).

Fifth Process

Thereafter, the signal processing unit 20 performs a thinning process. More specifically, the signal processing unit 20 selects an output signal of a sub pixel except a sub pixel that is not included in each pixel, and generates a thinned output signal. Specifically, the signal processing unit 20 excludes the output signal $X_{4A-(p,q)}$ of the fourth sub pixel 49R of the pixel 48A of the (p,q)-th pixel 48 to generate a thinned output signal having only the signal value $X_{1A-(p,q)}$ of the first sub pixel 49B, the signal value $X_{2A-(p,q)}$ of the second sub pixel 49W, and the signal value $X_{3A-(p,q)}$ of the third sub pixel 49G. The signal processing unit 20 excludes the output signal $X_{3B-(p,q)}$ of the third sub pixel 49G of the pixel 48B of the (p,q)-th pixel 48 to generate a thinned output signal having only the signal value $X_{1B-(p,q)}$ of the first sub pixel 49B, the signal value $X_{2B-(p,q)}$ of the second sub pixel 49W, and the signal value $X_{4B-(p,q)}$ of the fourth sub pixel 49R.

Display Image Example

Next, a display image when an image is displayed on the image display panel 40 will be described. First, an image display by an image display panel 40X including only the first sub pixel 49B, the third sub pixel 49G, and the fourth sub pixel 49R will be described. In other words, the image display panel 40X is configured with pixels 48X having three colors of R, G, and B unlike the image display panel 40 according to the first embodiment.

Figure 8:
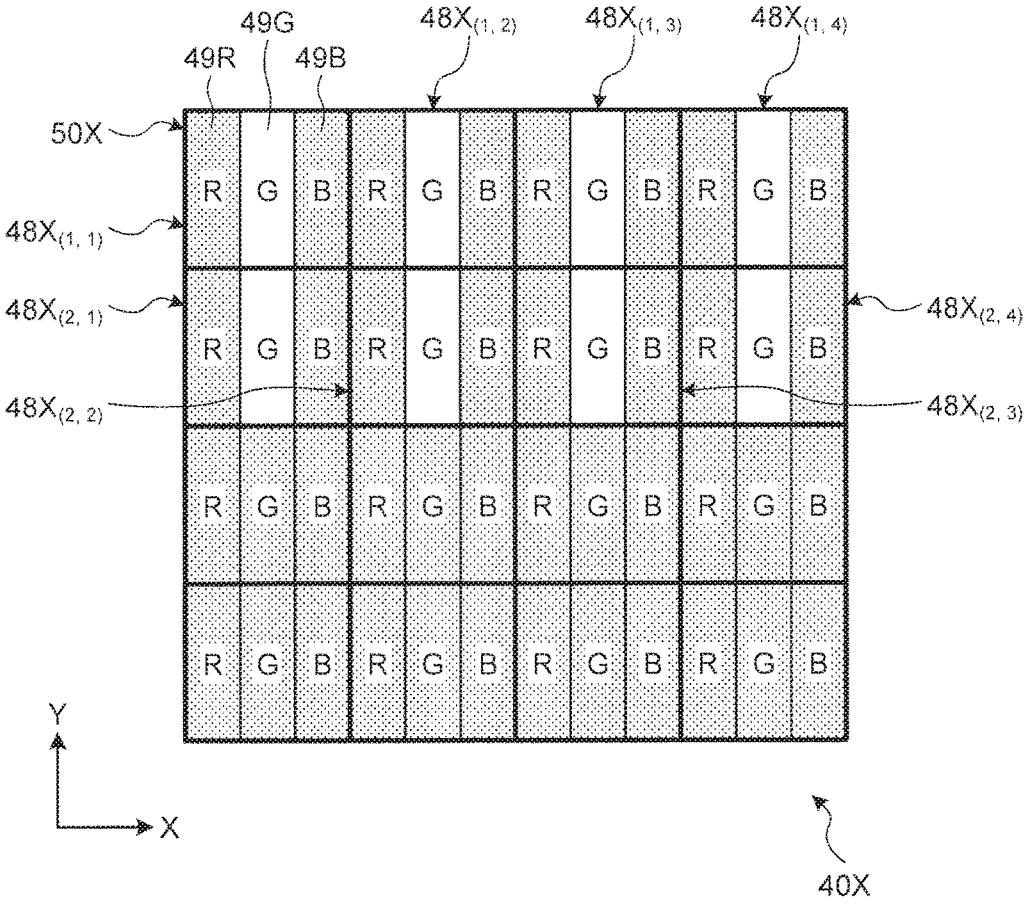
FIG.8 RELATED ART
FIG. 8 is a schematic diagram illustrating an image display example of an image display panel configured with only pixels having three colors of R, G, and B.

FIG. 8 is a schematic diagram illustrating an image display example of an image display panel configured with only pixels having three colors of R, G, and B. The image display panel 40X is configured with only pixels 48X each including a first sub pixel 49B, a third sub pixel 49G, and a fourth sub pixel 49R as illustrated in FIG. 8. In the pixels 48X, the fourth sub pixel 49R, the third sub pixel 49G, and the first sub pixel 49B are arranged in the X direction in a stripe form in the described order. In the image display panel 40X, a region of the first sub pixel 49B, the third sub pixel 49G, and the fourth sub pixel 49R is identical to a pixel display region 50X. In other words, a region of the pixel 48X is identical to the pixel display region 50X. The pixel display region 50X has the same shape as the pixel display region 50S according to the first embodiment.

FIG. 8 illustrates an example in which when the control device 11 outputs input signals to display straight lines of green extending in first and second rows of a pixel array in the X direction, the image display panel 40X displays an image based on the input signals. In the image display panel 40X, when the (p,q)-th pixel 48 (here, $1 \le p \le P$ and $1 \le q \le Q$) is described as a $\mathrm{pixel}_{(p,q)}$, the third sub pixels 49G of the pixel $\mathbf{48}_{(1,1)}$, the pixel $\mathbf{48}_{(1,2)}$, the pixel $\mathbf{48}_{(1,3)}$, the pixel $\mathbf{48}_{(1,4)}$, the pixel $48_{(2,1)}$, the pixel $48_{(2,2)}$, the pixel $48_{(2,3)}$ and the pixel $48_{(2,4)}$ are turned on as illustrated in FIG. 8. In the image display panel 40X, since all pixels include the third sub pixel 49G, and the third sub pixels 49G in the pixels 48X in the first and second rows are turned on, straight lines of green extending in the first and second rows in the X direction according to the input signals are displayed.

Figure 9:
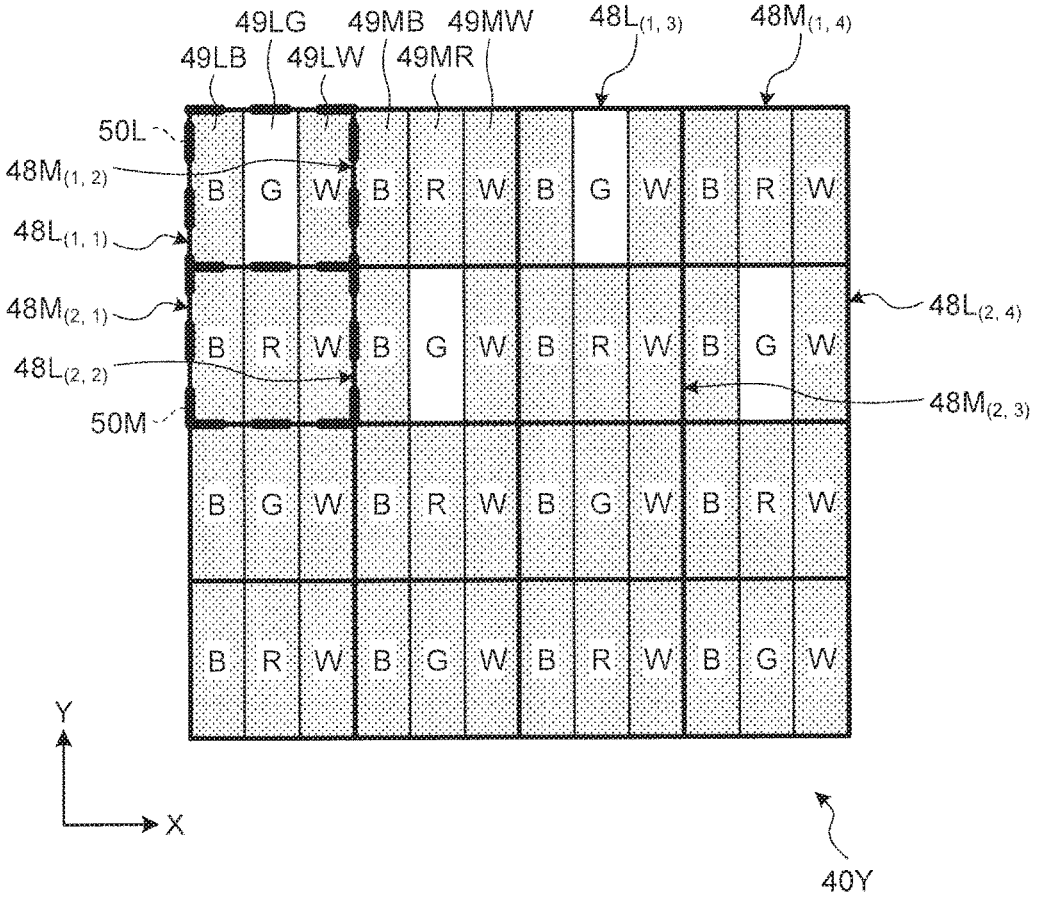
FIG.9 RELATED ART
FIG. 9 is a diagram illustrating an image display example of an image display panel according to a comparative example.

Next, an example in which an image display panel 40Y according to the comparative example similarly displays an image based on input signals for displaying straight lines of green extending in first and second rows of a pixel array in the X direction will be described. FIG. 9 is a diagram illustrating an image display example of an image display panel according to a comparative example. The image display panel 40Y according to the comparative example includes the first sub pixel 49B, the second sub pixel 49W, the third sub pixel 49G, and the fourth sub pixel 49R, similarly to the image display panel 40 according to the first embodiment as illustrated in FIG. 9. The image display panel 40Y includes the second sub pixel 49W and thus can make an image brighter than in the image display panel 40X.

In the image display panel 40Y, a pixel 48L and a pixel 48M are alternately arranged in the X direction and the Y direction as illustrated in FIG. 9. In the pixel 48L, a first sub pixel 49LB, a third sub pixel 49LG, and a second sub pixel 49LW are arranged in the X direction in a stripe form in the described order. In the pixel 48M, a first sub pixel 49MB, a fourth sub pixel 49MR, and a second sub pixel 49MW are arranged in the X direction in a stripe form in the described order. In other words, in the image display panel 40Y, a pixel including no third sub pixel 49G and a pixel including no fourth sub pixel 49R are alternately arranged, similarly to the image display panel 40 according to the first embodiment. In the image display panel 40Y, a region of the pixel 48L is identical to a pixel display region 50L, and a region of the pixel 48M is identical to a pixel display region 50M.

FIG. 9 illustrates an example in which when the control device 11 outputs input signals to display the straight lines of green extending in the first and second rows in the X direction, the image display panel 40Y displays an image based on the input signals. In the image display panel 40Y, the third sub pixels 49G of the pixel $48L_{(1,1)}$, the pixel $48L_{(2,2)}$, the pixel $48L_{(1,3)}$, and the pixel $48L_{(2,4)}$ are turned on as illustrated in FIG. 9. In the image display panel 40Y, the pixel 48L including the third sub pixel 49G and the pixel 48M including no third sub pixel 49G are alternately arranged in the X direction and the Y direction. Thus, only the pixels 48L in the first row and the second row are turned on, and the pixels 48M in the first row and the second row are not turned on. For this reason, the image display panel 40Y displays a line segment that extends in the X direction in a jagged shape unlike the straight line displayed based on the input signals. As described above, when the pixel including no third sub pixel 49G and the pixel including no fourth sub pixel 49R are alternately arranged as in the image display panel 40Y, there are cases in which an image deteriorates.

Figure 10:
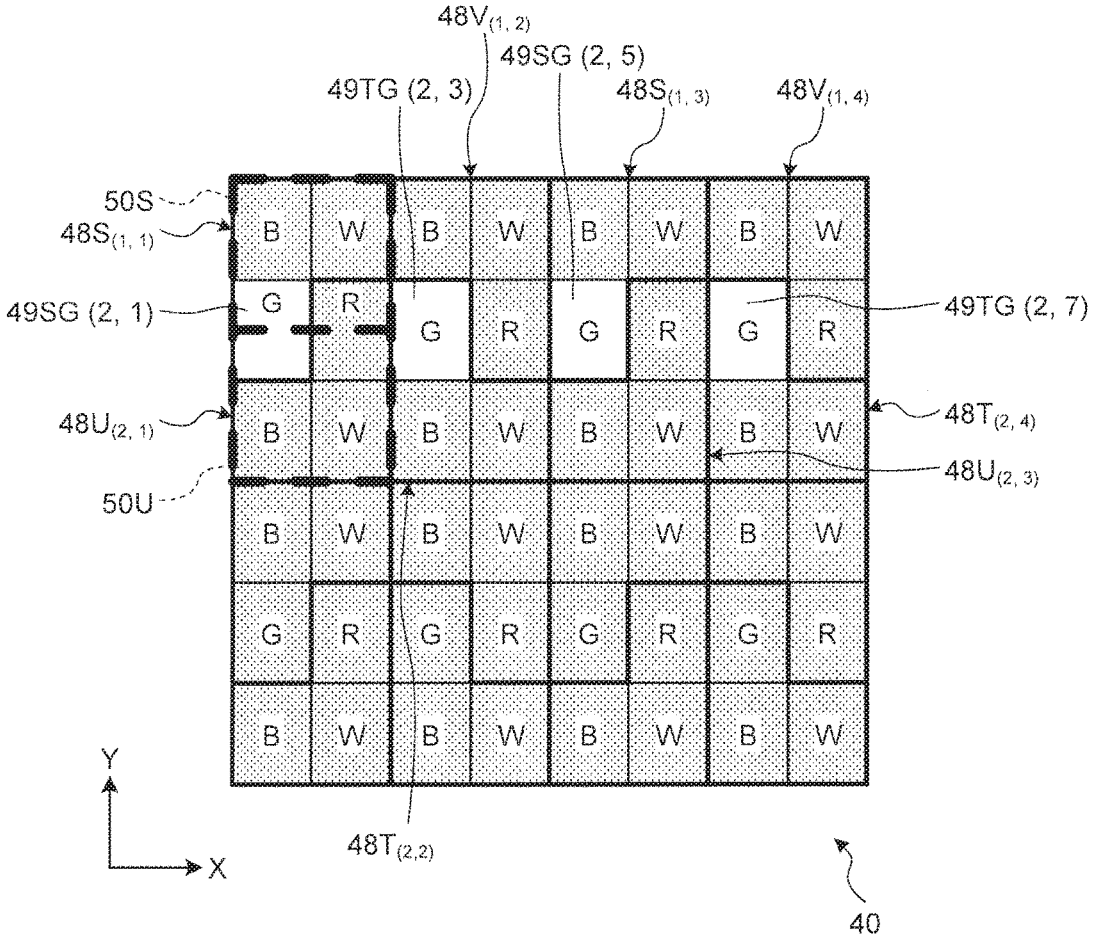
FIG. 10 is a diagram illustrating an image display example of the image display panel according to the first embodiment.

Next, an example in which the image display panel 40 according to the first embodiment similarly displays an image based on input signals for displaying the straight lines of green extending in the first and second rows of the pixel array in the X direction will be described. FIG. 10 is a diagram illustrating an image display example of the image display panel according to the first embodiment. FIG. 10 illustrates an example in which when the control device 11 outputs the input signals so that the straight lines of green extending in the first and second rows of the pixel array in the X direction are displayed, the image display panel 40 displays an image based on the input signals.

In the image display panel 40, the third sub pixels 49G of the pixel $48S_{(1,1)}$, the pixel $48T_{(2,2)}$, the pixel $48S_{(1,3)}$, and the pixel $48T_{(2,4)}$ are turned on as illustrated in FIG. 10. In the image display panel 40, since the pixel 48L including the third sub pixel 49G and the pixel 48M including no third sub pixel 49G are alternately arranged in the X direction and the Y direction, an arrangement of the pixels 48 to be turned on is the same as in the image display panel 40 according to the comparative example.

However, in the image display panel 40, the third sub pixel 49G extends up to the pixel display region 50 facing in the Y direction. In other words, the third sub pixel 49G overlaps the fourth sub pixel 49R in the Y direction. For this reason, the third sub pixels 49G overlap in the Y direction as well. More specifically, the third sub pixels 49G of the pixel $48S_{(1,1)}$, the pixel $48T_{(2,2)}$, the pixel $48S_{(1,3)}$, and the pixel $48T_{(2,4)}$ are in the second row which is the same row in the array of the sub pixels 49. In other words, the third sub pixels 49G of the pixel $48S_{(1,1)}$, the pixel $48T_{(2,2)}$, the pixel $48S_{(1,3)}$, and the pixel $48T_{(2,4)}$ are the third sub pixel 49SG(2,1), the third sub pixel 49TG(2,3), the third sub pixel 49SG(2,5), and the third sub pixel 49TG(2,7), respectively. Thus, the image display panel 40 turns on the third sub pixels 49G in the same row in the array of the sub pixels 49. It is possible to display a straight line extending in the X direction according to an instruction of the input signal instead of the jagged line segment of the image display panel 40Y. Accordingly, the image display panel 40 can suppress deterioration of an image.

As described above, in the image display panel 40 according to the first embodiment, the region of the first sub pixel 49B and the second sub pixel 49W of the pixel 48A, the region of one part of the third sub pixel 49G of the pixel 48A, and the region of one part of the fourth sub pixel 49R of the pixel 48B are arranged in the pixel display region 50A. The region of the first sub pixel 49B and the second sub pixel 49W of the pixel 48B, the region of the other part of the third sub pixel 49G of the pixel 48A, and the region of the other part of the fourth sub pixel 49R of the pixel 48B are arranged in the pixel display region 50B. Thus, for example, when a straight line of a sub pixel (the third sub pixel 49G or the fourth sub pixel 49R) which is not included in any of the pixel 48A and the pixel 48B is displayed, the image display panel 40 can suppress deterioration of an image.

In the image display panel 40, the pixel display region 50A and the pixel display region 50B have the same shape. Thus, the image display panel 40 can display an image appropriately corresponding to the input signal. Since the third sub pixel 49G and the fourth sub pixel 49R are arranged in both the pixel display region 50A and the pixel display region 50B, and the pixel display region 50A and the pixel display region 50B have the same shape, it is possible to appropriately suppress deterioration of an image displayed by the third sub pixel 49G and the fourth sub pixel 49R. The pixel display region 50A and the pixel display region 50B may not have the same shape.

In the image display panel 40, the region of one part and the region of the other part of the third sub pixel 49G have the same area, and the region of one part and the region of the other part of the fourth sub pixel 49R have the same area. The region of one part and the region of the other part of the third sub pixel 49G are positioned in the pixel display region 50A and the pixel display region 50B, respectively. Thus, the third sub pixels 49G in the respective pixel display region have the same area, and the fourth sub pixels 49R in the respective pixel display regions have the same area. Accordingly, the image display panel 40 can appropriately suppress deterioration of color balance. The third sub pixels 49G in the respective pixel display regions may not have the same area, and the fourth sub pixels 49R in the respective pixel display regions need not necessarily have the same area. The third sub pixels 49G in the respective pixel display regions and the fourth sub pixels 49R in the respective pixel display regions need not necessarily have the same area.

The first sub pixel 49B and the second sub pixel 49W have the same shape, and the third sub pixel 49G and the fourth sub pixel 49R have the same shape. Thus, the image display panel 40 can suppress deterioration of color balance. The first sub pixel 49B, the second sub pixel 49W, the third sub pixel 49G, and the fourth sub pixel 49R may not have the same shape.

The pixel 48 includes four sub pixels, that is, the first sub pixel 49B, the second sub pixel 49W, the third sub pixel 49G, and the fourth sub pixel 49R, but the pixel 48 is not limited to this example and may include five or more sub pixels displaying different colors. In other words, when d is an integer of 4 or larger, the pixel 48 may include a total of d sub pixels of first to d-th sub pixels displaying different colors. In this case, the pixel 48A includes first to (d−2)-th sub pixels and a (d−1)-th sub pixel, and the pixel 48B includes first to (d−2)-th sub pixels and a d-th sub pixel. A region in which the first to (d−2)-th sub pixels of the pixel 48A are arranged, one part of the (d−1)-th sub pixel, and one part of the d-th sub pixel are arranged in the pixel display region 50A. A region in which the first to (d−2)-th sub pixels of the pixel 48B are arranged, the other part of the (d−1)-th sub pixel, and the other part of the d-th sub pixel are arranged in the pixel display region 50B.

In this case, preferably, the one part of the (d−1)-th sub pixel and the other part of the (d−1)-th sub pixel have the same area, and the one part of the d-th sub pixel and the other part of the (d−2)-th sub pixel have the same area. Preferably, the first to (d−2)-th sub pixels have the same shape, and the (d−1)-th and d-th sub pixels have the same shape. For example, preferably, the first to d-th sub pixels are arranged in the X direction and the Y direction in a matrix form. Preferably, the (d−1)-th and d-th sub pixels overlaps in the Y direction and are adjacent to each other. Not all the first to d-th sub pixels may display different colors, and for example, at least one sub pixel simply needs to display a different color from any one of the other sub pixels. In this case, for example, the pixel 48 may include two or more sub pixels of the same color.

Second Embodiment

Next, a second embodiment will be described. A display device 10A according to the second embodiment differs from the display device 10 according to the first embodiment in that a signal processing unit 20A performs an input signal averaging process. In the display device 10A according to the second embodiment, the remaining configuration including an image display panel 40A is the same as in the display device 10 according to the first embodiment, and a description thereof is not repeated.

Figure 11:
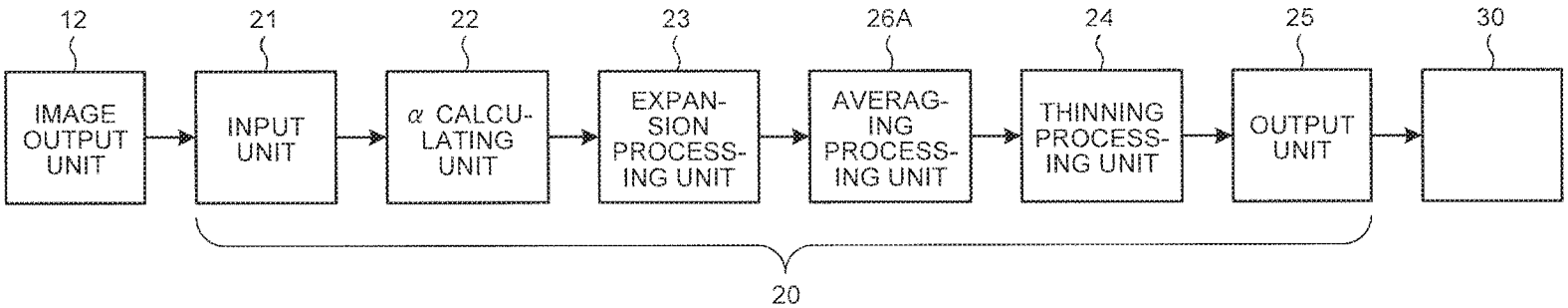
FIG. 11 is a block diagram illustrating a configuration of a signal processing unit according to a second embodiment.

FIG. 11 is a block diagram illustrating a configuration of the signal processing unit according to the second embodiment. As illustrated in FIG. 11, the signal processing unit 20A includes an averaging processing unit 26A between the expansion processing unit 23 and the thinning processing unit 24. The averaging processing unit 26A obtains the corrected output signal value of the third sub pixel 49G of the pixel 48A based on the input signal value to the third sub pixel 49G of the pixel 48A and the input signal value to the third sub pixel 49G of the pixel 48B adjacent to the pixel 48A. The signal processing unit 20A obtains the corrected output signal value of the fourth sub pixel 49R of the pixel 48B based on the input signal value to the fourth sub pixel 49R of the pixel 48A and the input signal value to the fourth sub pixel 49R of the pixel 48A adjacent to the pixel 48B.

More specifically, the averaging processing unit 26A calculates a corrected output signal $XA_{3A-(p,q)}$ of the third sub pixel 49G in the pixel 48A of the (p,q)-th pixel 48 based on the signal value $X_{3A-(p,q)}$ of the third sub pixel 49G in the pixel 48A of the (p,q)-th pixel 48 and the signal value $X_{3B-(p,q)}$ of the third sub pixel 49G in the pixel 48B of the pixel 48 adjacent to the pixel 48A of the (p,q)-th pixel 48 that are calculated by the expansion processing unit 23.

The averaging processing unit 26A calculates a corrected output signal $XA_{4B-(p,q)}$ of the fourth sub pixel 49R in the pixel 48B of the (p,q)-th pixel 48 based on the signal value $X_{4B-(p,q)}$ of the fourth sub pixel 49R in the pixel 48B of the (p,q)-th pixel 48 and the signal value $X_{4A-(p,q)}$ of the fourth sub pixel 49R in the pixel 48A of the pixel 48 adjacent to the pixel 48B of the (p,q)-th pixel 48 that are calculated by the expansion processing unit 23.

In the present embodiment, the averaging processing unit 26A selects the pixel 48B adjacent to the previous row side of the pixel 48A in the Y direction as a counterpart in the averaging process on the pixel 48A. In other words, when the pixel 48B adjacent to the previous row side of the pixel 48A is the pixel 48B of the (p−1,q)-th pixel 48, the averaging processing unit 26A performs the averaging process with the pixel 48B of the (p−1,q)-th pixel 48. When the pixel 48B adjacent to the previous row side of the pixel 48A is the pixel 48B of the (p,q)-th pixel 48, the averaging processing unit 26A performs the averaging process with the pixel 48B of the (p,q)-th pixel 48. The averaging processing unit 26A may select the pixel 48B that is adjacent to the pixel 48A in either of the X direction and the Y direction as the pixel 48B adjacent to the pixel 48A of the (p,q)-th pixel 48.

Similarly, the averaging processing unit 26A selects the pixel 48A adjacent to the previous row side of the pixel 48B in the Y direction as a counterpart in the averaging process on the pixel 48B. In other words, when the pixel adjacent to the previous row side of the pixel 48B is the pixel 48A of the (p−1,q)-th pixel 48, the averaging processing unit 26A performs the averaging process with the pixel 48A of the (p−1,q)-th pixel 48. When the pixel adjacent to the previous row side of the pixel 48B is the pixel 48A of the (p,q)-th pixel 48, the averaging processing unit 26A performs the averaging process with the pixel 48A of the (p,q)-th pixel 48. The averaging processing unit 26A may select the pixel 48A that is adjacent to the pixel 48B in either of the X direction and the Y direction as the pixel 48A adjacent to the pixel 48B of the (p,q)-th pixel 48.

More specifically, the averaging processing unit 26A calculates the corrected output signal $XA_{3A-(p,q)}$ of the third sub pixel 49G of the pixel 48A based on the following Formula (11) or (12). When the pixel 48B adjacent to the pixel 48A of the (p,q)-th pixel 48 at the previous row side is the pixel 48B of the (p−1,q)-th pixel 48, the averaging processing unit 26A uses Formula (11). When the pixel 48B adjacent to the pixel 48A of the (p,q)-th pixel 48 at the previous row side is the pixel 48B of the (p,q)-th pixel 48, the averaging processing unit 26A uses Formula (12).

$$XA_{3A-(p,q)}=(f\cdot X_{3A-(p,q)}+g\cdot X_{3B-(p-1,q)})/(f+g) \quad (11)$$

$$XA_{3A-(p,q)}=(f\cdot X_{3A-(p,q)}+g\cdot X_{3B-(p,q)})/(f+g) \quad (12)$$

Here, f and g are certain coefficients, and in the first embodiment, f and g are 1. f and g are not limited to 1 as long as the corrected output signal $XA_{3A-(p,q)}$ is obtained by performing the averaging process at a certain ratio. The averaging process by the averaging processing unit 26A is not limited to Formula (11) and Formula (12), and the averaging process may be performed by, for example, a geometric mean or the like. For example, preferably, $XA_{3A-(p,q)}$ is a value of a smaller value of $X_{3A-(p,q)}$ and $X_{3B-(p-1,q)}$ to a larger value of $X_{3A-(p,q)}$ and $X_{3B-(p-1,q)}$.

The averaging processing unit 26A calculates the corrected output signal $XA_{4B-(p,q)}$ of the fourth sub pixel 49R of the pixel 48B based on the following Formula (13) or Formula (14). When the pixel 48A adjacent to the pixel 48B of the (p,q)-th pixel 48 at the previous row side is the pixel 48A of the (p−1,q)-th pixel 48, the averaging processing unit 26A uses Formula (13). When the pixel 48A adjacent to the pixel 48B of the (p,q)-th pixel 48 at the previous row side is the pixel 48A of the (p,q)-th pixel 48, the averaging processing unit 26A uses Formula (14).

$$XA_{4B-(p,q)}=(h\cdot X_{4B-(p,q)}+i\cdot X_{4A-(p-1,q)})/(h+i) \quad (13)$$

$$XA_{4B-(p,q)}=(h\cdot X_{4B-(p,q)}+i\cdot X_{4A-(p,q)})/(h+i) \quad (14)$$

Here, h and i are certain coefficients, and in the first embodiment, h and i are 1. h and i are not limited to 1 as long as the corrected output signal $XA_{4B-(p,q)}$ is obtained by performing the averaging process at a certain ratio. For example, it is preferable that h has the same value as f, and i have the same value as g. The averaging process by the averaging processing unit 26A is not limited to Formulas (13) and (14), and the averaging process may be performed, for example, by the geometric mean or the like. For example, $XA_{4B-(p,q)}$ is preferably a value of a smaller value of $X_{4B-(p,q)}$ and $X_{4A-(p-1,q)}$ to a larger value of $X_{4B-(p,q)}$ and $X_{4A-(p-1,q)}$.

Figure 12:
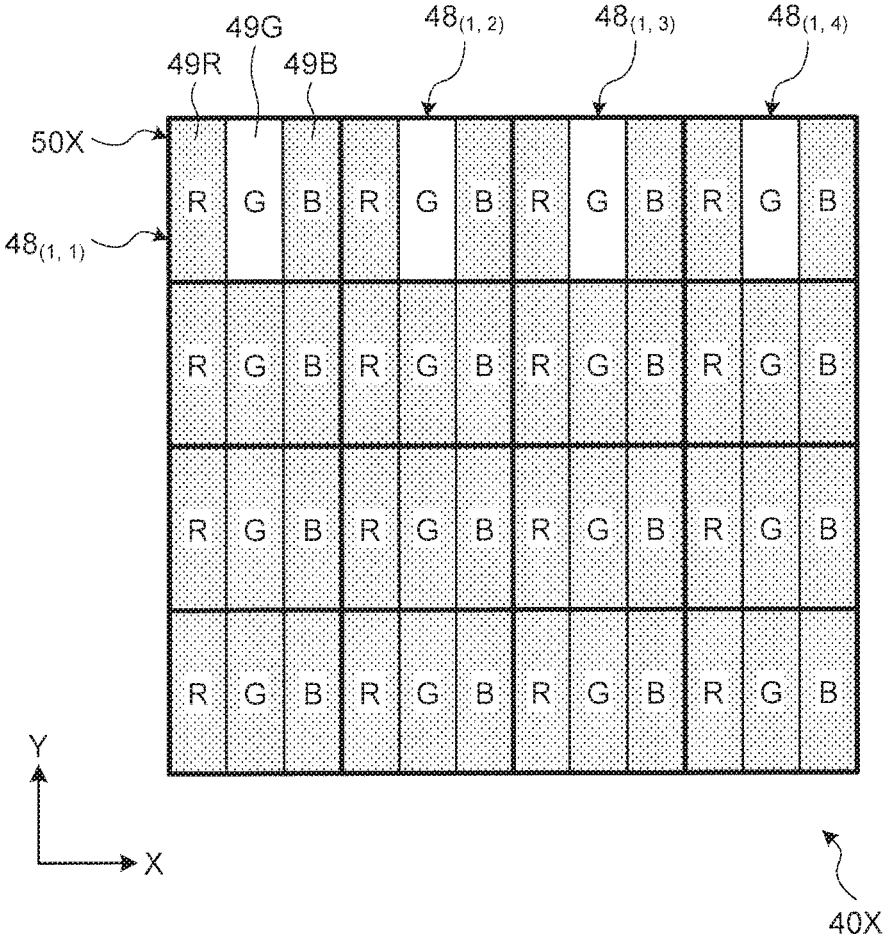
FIG.12 RELATED ART
FIG. 12 is a schematic diagram illustrating an image display example of an image display panel configured with only pixels having three colors of R, G, and B.

Next, a display image when an image is displayed on the image display panel 40A will be described. First, an image display by the image display panel 40X configured with only pixels of three colors of R, G, and B will be described. FIG. 12 is a schematic diagram illustrating an image display example of an image display panel configured with only pixels of three colors of R, G, and B. FIG. 12 illustrates an example in which when the control device 11 outputs input signals for displaying the straight line of green extending in the first row of the pixel array in the X direction, the image display panel 40X displays an image based on the input signals.

In the image display panel 40X, when the (p,q)-th pixel 48 (here, 1≤p≤P, 1≤q≤Q) is described as a $pixel_{(p,q)}$, the third sub pixels 49G of the pixel $\mathbf{48}_{(1,1)}$, the pixel $\mathbf{48}_{(1,2)}$, the pixel $\mathbf{48}_{(1,3)}$, the pixel $\mathbf{48}_{(1,4)}$ are turned on as illustrated in FIG. 12. Since the image display panel 40X turns on the third sub pixels 49G of the pixels 48X in the first row of the pixel array, the straight line of green extending in the first row in the X direction according to the input signals is displayed.

Figure 13:
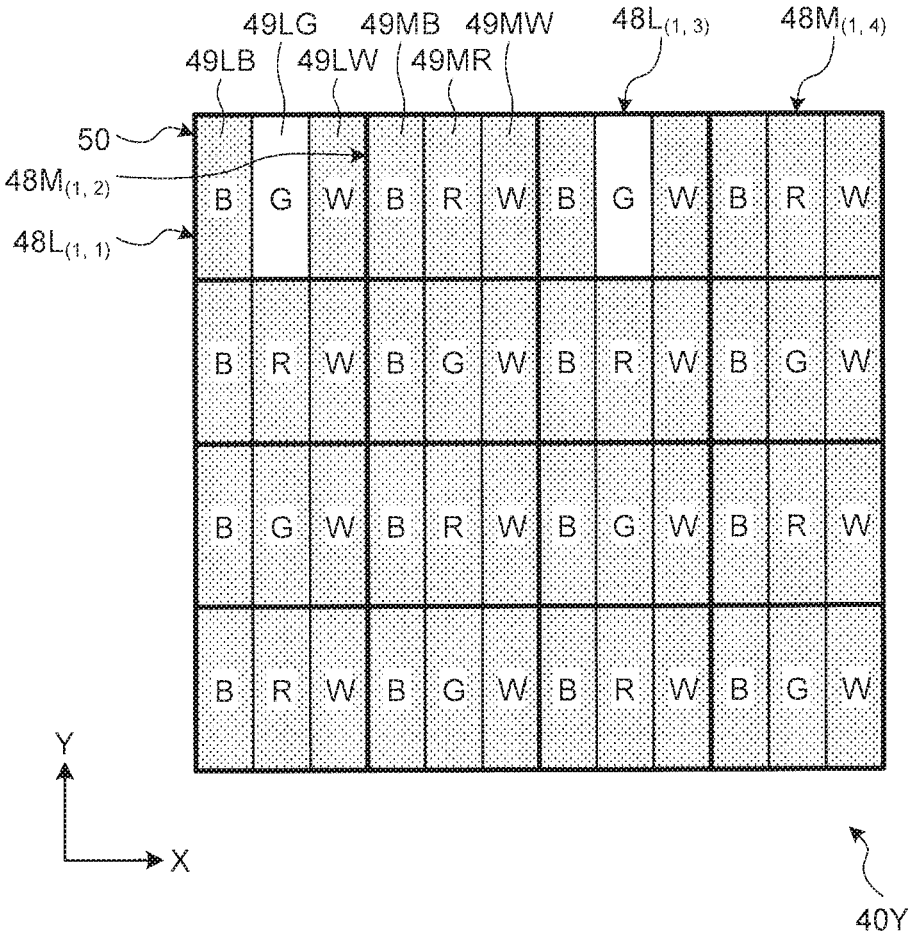
FIG.13 RELATED ART
FIG. 13 is a diagram illustrating an image display example of an image display panel according to a comparative example.

Next, an example in which when the image display panel 40Y according to the comparative example similarly displays an image based on input signals for displaying the straight line of green extending in the first row of the pixel array in the X direction will be described. FIG. 13 is a diagram illustrating an image display example of the image display panel according to the comparative example. FIG. 13 illustrates an example in which when the control device 11 outputs the input signals for displaying the straight line of green extending in the first row in the X direction, the image display panel 40Y displays an image based on the input signals. In the image display panel 40Y, the third sub pixels 49G of the pixel $\mathbf{48}L_{(1,1)}$ and the pixel $\mathbf{48}L_{(1,3)}$ are turned on as illustrated in FIG. 13. In the image display panel 40Y, the pixel 48L including the third sub pixel 49G and the pixel 48M including no third sub pixel 49G are alternately arranged in the X direction and the Y direction. Thus, only the pixels 48L in the first row are turned on, but the pixels 48M in the first row are not turned on. For this reason, in the image display panel 40Y, the resolution of the straight line of green extending in the first row in the X direction is likely to deteriorate, and an image is likely to deteriorate.

Figure 14:
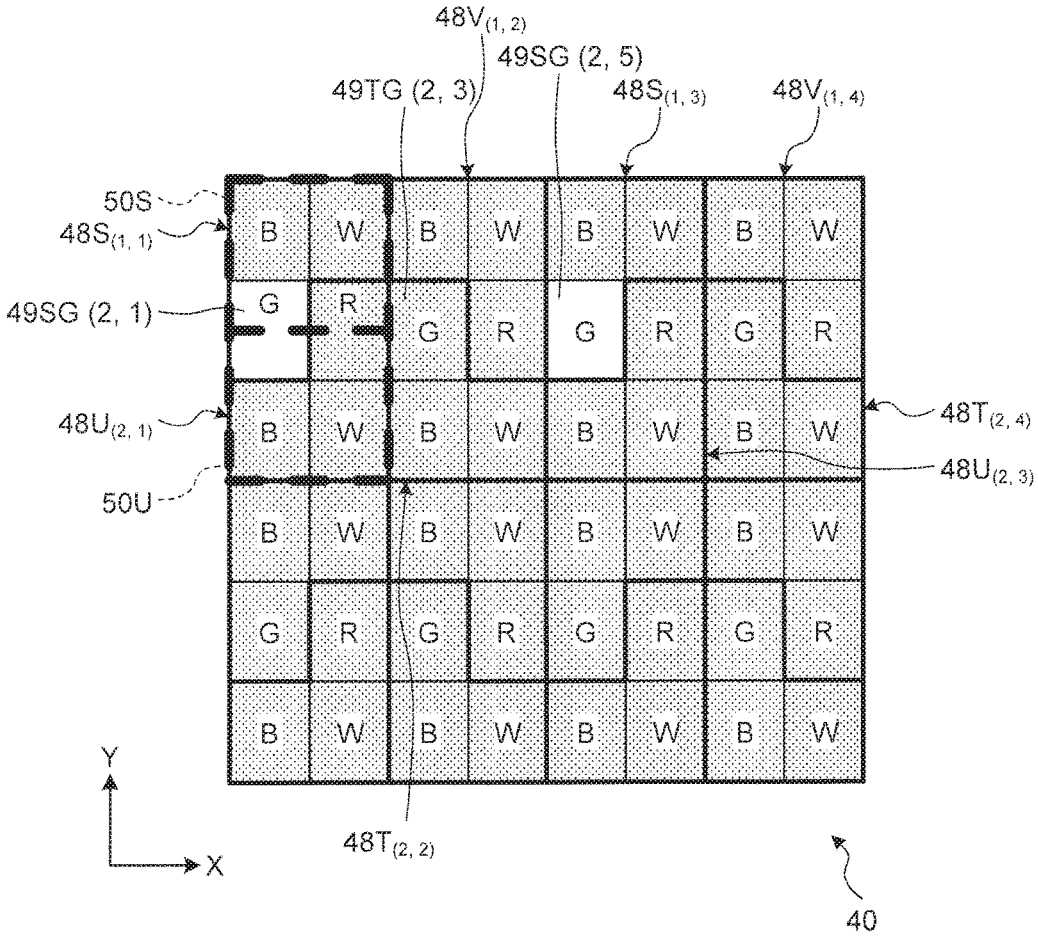
FIG. 14 is a diagram illustrating an image display example of the image display panel according to the first embodiment.

Next, an example in which the image display panel 40 according to the first embodiment similarly displays an image based on input signals for displaying the straight line of green extending in the first row of the pixel array in the X direction will be described. FIG. 14 is a diagram illustrating an image display example of the image display panel according to the first embodiment. FIG. 14 illustrates an example in which when the control device 11 outputs the input signals for displaying the straight line of green extending in the first row of the pixel array in the X direction, the image display panel 40 displays an image based on the input signals. In the first embodiment, the averaging process according to the second embodiment is not performed.

In the image display panel 40, the third sub pixels 49G of the pixel $\mathbf{48}L_{(1,1)}$ and the pixel $\mathbf{48}L_{(1,3)}$ are turned on as illustrated in FIG. 14. In other words, in the image display panel 40, the third sub pixel 49SG(2,1) and the third sub pixel 49SG(2,5) are turned on. In other words, for example, when the image display panel 40 displays the straight line of green extending in the first row of the pixel array in the X direction, there is a possibility that it will be difficult to suppress deterioration of an image.

Figure 15:
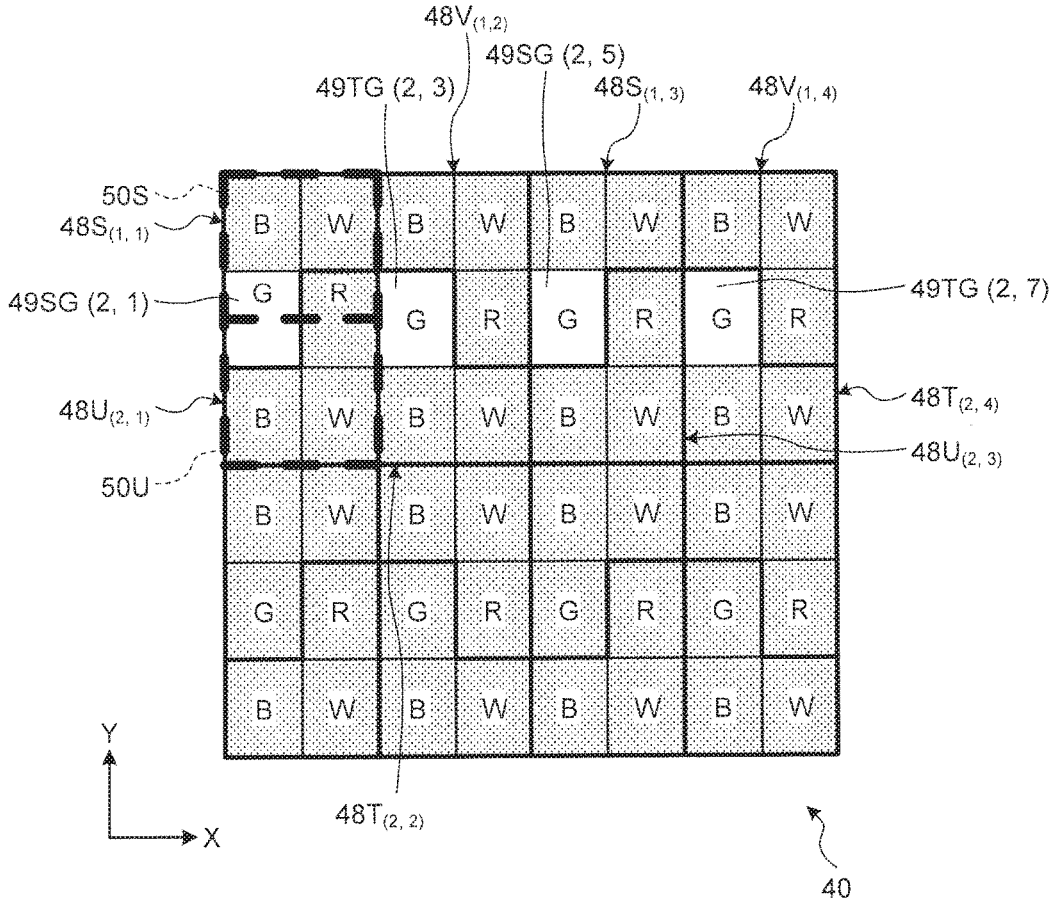
FIG. 15 is a diagram illustrating an image display example of the image display panel according to the second embodiment.

Next, an example in which the image display panel 40A according to the second embodiment similarly displays an image based on input signals for displaying the straight line of green extending in the first row of the pixel array in the X direction will be described. FIG. 15 is a diagram illustrating an image display example of the image display panel according to the second embodiment. FIG. 15 illustrates an example in which when the control device 11 outputs the input signals for displaying the straight line of green extending in the first row in the X direction, the image display panel 40A displays an image based on the input signals.

In the image display panel 40A, the third sub pixels 49G of the pixel $\mathbf{48}S_{(1,1)}$, the pixel $\mathbf{48}T_{(2,2)}$, the pixel $\mathbf{48}S_{(1,3)}$, and the pixel $\mathbf{48}T_{(2,4)}$ are turned on as illustrated in FIG. 15. In other words, in the image display panel 40A, the third sub pixel 49SG(2,1), the third sub pixel 49TG(2,3), the third sub pixel 49SG(2,5), the third sub pixel 49TG(2,7) in the array of the sub pixels 49 are turned on. The input signal for turning on the third sub pixel 49G is not input to the pixel $\mathbf{48}T_{(2,2)}$ and the pixel $\mathbf{48}T_{(2,4)}$. However, the averaging process is performed on the pixel $\mathbf{48}T_{(2,2)}$ with the pixel $\mathbf{48}V_{(1,2)}$ to which the input signal of the third sub pixel 49G is input. Similarly, the averaging process is performed on the pixel $\mathbf{48}T_{(2,4)}$ with the pixel $\mathbf{48}V_{(1,4)}$ to which the input signal of the third sub pixel 49G is input. Thus, the third sub pixel 49TG(2,3) of the pixel $\mathbf{48}T_{(2,2)}$ and the third sub pixel 49TG(2,7) of the pixel $\mathbf{48}T_{(2,4)}$ are turned on. The third sub pixel 49SG(2,1), the third sub pixel 49TG(2,3), the third sub pixel 49SG(2,5), and the third sub pixel 49TG(2,7) undergo the averaging process based on a one-to-one arithmetic average. Thus, in the present embodiment, the value of the corrected output signal that has undergone the averaging process becomes a value that is half the value of the output signal that has not undergone the averaging process.

As described above, the display device 10A according to the second embodiment performs the averaging process and thus can display the straight line extending in the X direction according to an instruction of the input signal without deteriorating the resolution. In other words, the display device 10A obtains the corrected output signal value of the third sub pixel 49G of the pixel 48A based on the input signal value to the third sub pixel 49G of the pixel 48A and the input signal value to the third sub pixel 49G of the pixel 48B adjacent to the pixel 48A. The display device 10A obtains the corrected output signal value of the fourth sub pixel 49R of the pixel 48B based on the input signal value to the fourth sub pixel 49R of the pixel 48A and the input signal value to the fourth sub pixel 49R of the pixel 48A adjacent to the pixel 48B. Thus, the display device 10A can display the straight line of green extending in the first row in the X direction, for example, without deteriorating the resolution and thus appropriately suppress deterioration of an image.

Third Embodiment

Next, a third embodiment will be described. A display device 10*a* according to the third embodiment differs from the display device 10 according to the first embodiment in that a pixel array of an image display panel 40*a* is different from that of the image display panel 40. The display device 10*a* according to the third embodiment has the same configuration as the display device 10 according to the first embodiment in the other points, and a description thereof is not repeated.

Figure 16:
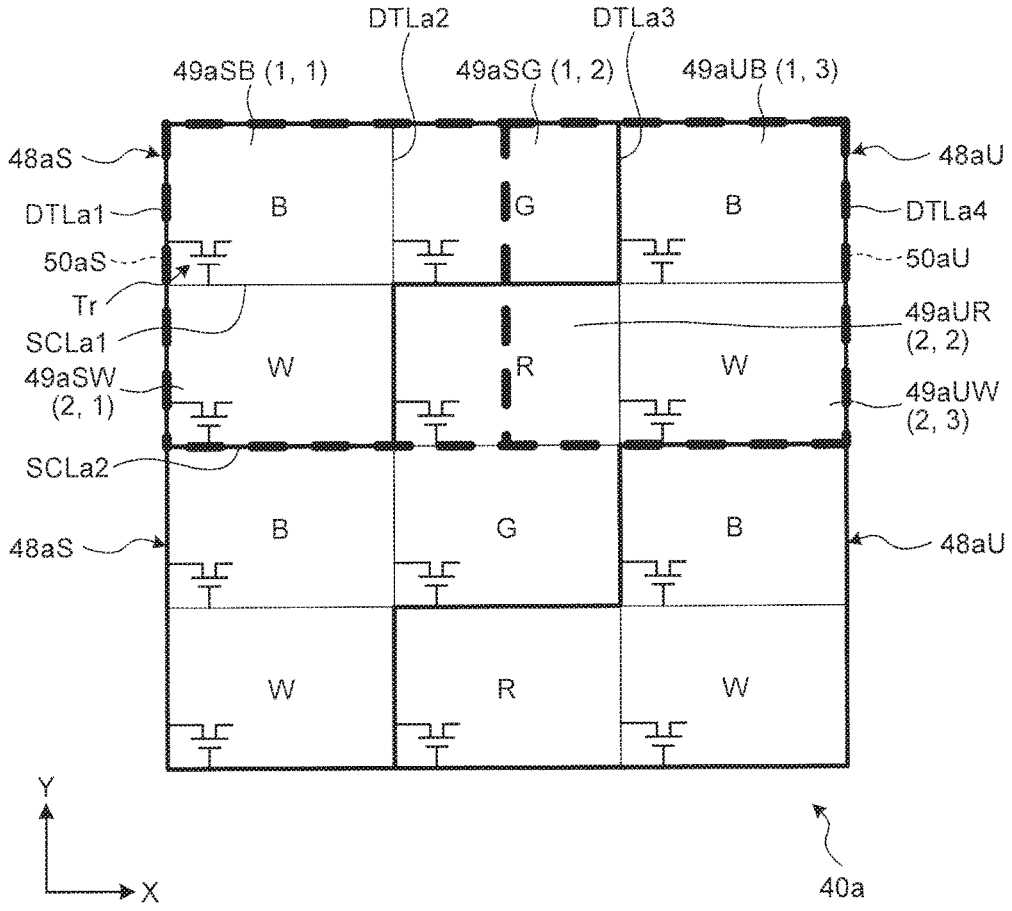
FIG. 16 is a schematic diagram illustrating a pixel array of an image display panel according to a third embodiment.

FIG. 16 is a schematic diagram illustrating a pixel array of the image display panel according to the third embodiment. As illustrated in FIG. 16, in the image display panel 40*a*, a pixel 48*a*S and a pixel 48*a*U configure a set of pixels 48*a* (pixel unit), and P×Q pixels 48*a* (pixel units) (P pixels in the row direction and Q pixels in the column direction) are arranged in a 2D matrix form.

In the third embodiment, the pixel 48*a*S and the pixel 48*a*U are alternately arranged in the X direction (the row direction). The pixel 48*a*S and the pixel 48*a*U are consecutively arranged in the Y direction (the column direction).

Sub pixels 49*a* of the pixel 48*a*S and the pixel 48*a*S are arranged in the X direction and the Y direction. The sub pixels 49*a* are arranged along a first row extending in the X direction and a second row arranged in a row next to the first row as illustrated in FIG. 16. The sub pixels 49 are arranged along a first column extending in the Y direction, a second column arranged in a column next to the first column, and a third column arranged in a column next to the second column. The first and second rows of the sub pixels 49 are periodically arranged in the Y direction, and the first to third columns of the sub pixels 49 are periodically arranged in the X direction.

Next, an array of the sub pixels 49*a* of the pixel 48*a*S and the pixel 48*a*U will be described under the assumption that in a row and column in which a sub pixel is arranged, a sub pixel 49 arranged in an s-th row and a t-th column is indicated by a sub pixel 49(*s*,*t*).

The pixel 48*a*S includes a first sub pixel 49*a*SB(1,1), a second sub pixel 49*a*SW(2,1), and a third sub pixel 49*a*SG (1,2) as illustrated in FIG. 16. In other words, the first sub pixel 49*a*SB(1,1) and the second sub pixel 49*a*SW(2,1) are arranged in the same column, that is, the first column and adjacent in the Y direction. The first sub pixel 49*a*SB(1,1) and the third sub pixel 49*a*SG(1,2) are adjacent in the X direction.

The pixel 48*a*U includes a first sub pixel 49*a*UB(1,3), a second sub pixel 49*a*UW(2,3), and a fourth sub pixel 49*a*UR(2,2). In other words, the first sub pixel 49*a*UB(1,3) and the second sub pixel 49*a*UW(2,3) are arranged in the same column, that is, the third column and adjacent in the Y direction. The second sub pixel 49*a*UW(2,3) and the fourth sub pixel 49*a*UR(2,2) are adjacent in the X direction. The fourth sub pixel 49*a*UR(2,2) and the third sub pixel 49*a*SG (1,2) of the pixel 48*a*S are arranged in the same column, that is, the second column and adjacent in the Y direction.

As described above, in the image display panel 40*a*, the third sub pixel 49*a*SG and the fourth sub pixel 49*a*UR are adjacent to each other in the Y direction. The third sub pixel 49*a*SG and the fourth sub pixel 49*a*UR need not necessarily be adjacent to each other when the third sub pixel 49*a*G and the fourth sub pixel 49*a*R overlap at least partially in the X direction.

Each of the sub pixels 49*a* arranged as described above is coupled to one of scanning lines SCLa1 and SCLa2 extending in the X direction and one of signal lines DTLa1, DTLa2, and DTLa3 extending in the Y direction via a switching element Tr.

The scanning line SCLa1 is coupled to the first sub pixel 49*a*SB(1,1) and the third sub pixel 49*a*SG(1,2) of the pixel 48*a*S and the first sub pixel 49*a*UB(1,3) of the pixel 48*a*U as illustrated in FIG. 16. The scanning line SCLa2 is coupled to the second sub pixel 49*a*SW(2,1) of the pixel 48*a*S and the fourth sub pixel 49*a*UR(2,2) and the second sub pixel 49*a*UW(2,3) of the pixel 48*a*U. In other words, in the third embodiment, it is possible to drive one pixel through control of two scanning lines SCL.

The signal line DTLa1 is coupled to the first sub pixel 49SB(1,1) and the second sub pixel 49*a*SW(2,1) of the pixel 48*a*S. The signal line DTLa2 is coupled to the third sub pixel 49SG(1,2) of the pixel 48*a*S and the fourth sub pixel 49*a*UR(2,2) of the pixel 48*a*U. The signal line DTLa3 is coupled to the first sub pixel 49*a*UB(1,3) and the second sub pixel 49*a*UW(2,3) of the pixel 48*a*U.

A pixel display region 50*a*S is adjacent to a pixel display region 50*a*U in the X direction as illustrated in FIG. 16. A region in which the first sub pixel 49*a*SB(1,1) and the second sub pixel 49*a*SW(2,1) of the pixel 48*a*S are arranged, a first column side region of regions obtained by dividing the third sub pixel 49*a*SG(1,2) of the pixel 48*a*S into two in the X direction, and a first column side region of regions obtained by dividing the fourth sub pixel 49*a*UR(2,2) of the pixel 48*a*U into two in the X direction are arranged in the pixel display region 50*a*S. A region in which the first sub pixel 49*a*UB(1,3) and the second sub pixel 49*a*UW(2,3) of the pixel 48*a*U are arranged, a third column side region of regions obtained by dividing the third sub pixel 49*a*SG(1,2) of the pixel 48*a*S into two the X direction, a third column side region of regions obtained by dividing the fourth sub pixel 49*a*UR(2,2) of the pixel 48*a*U into two in the X direction are arranged in the pixel display region 50*a*U.

As described above, in the image display panel 40*a* according to the third embodiment, a previous column side region of the two regions divided in the X direction in the third sub pixel 49G and the fourth sub pixel 49R is arranged in the pixel display region 50*a*S. A next column side region of the two regions divided in the X direction in the third sub pixel 49G and the fourth sub pixel 49R is arranged in the pixel display region 50*a*U. Thus, the image display panel 40*a* according to the third embodiment can suppress deterioration of an image, similarly to the image display panel 40 according to the first embodiment.

Fourth Embodiment

Next, a fourth embodiment will be described. A display device 10*b* according to the fourth embodiment differs from the display device 10 according to the first embodiment in that a pixel array of an image display panel 40*b* is different from that of the image display panel 40. The display device 10*b* according to the fourth embodiment has the same configuration as the display device 10 according to the first embodiment in the other points, and a description thereof is not repeated.

Figure 17:
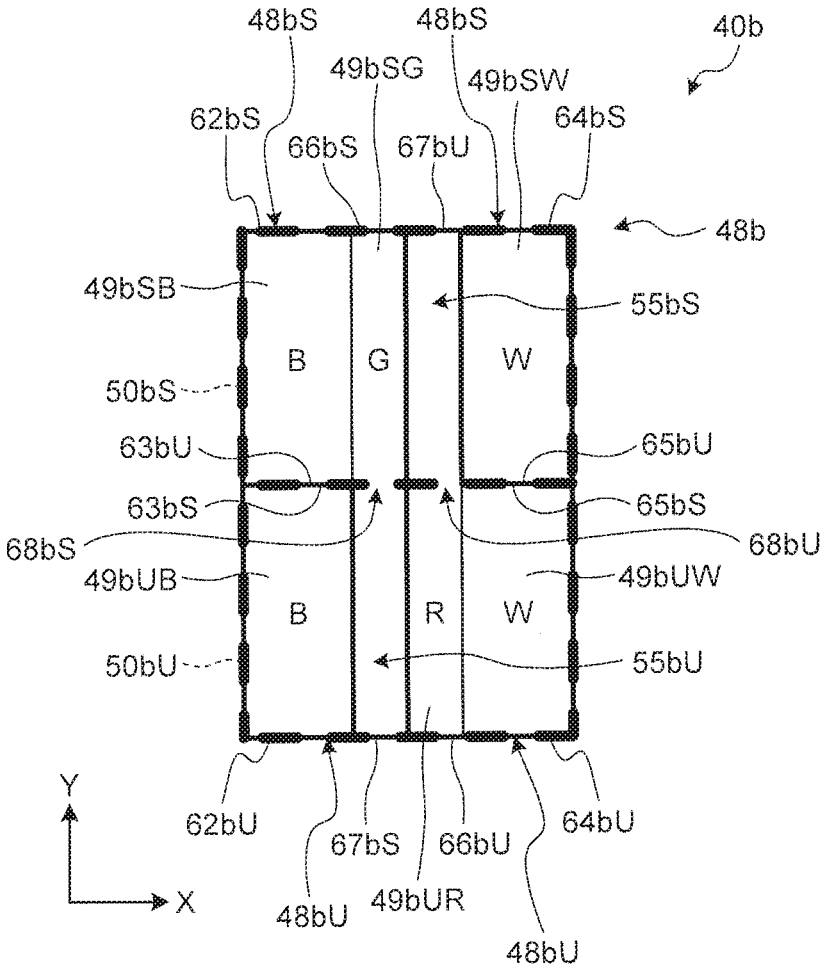
FIG. 17 is a schematic diagram illustrating a pixel array of an image display panel according to a fourth embodiment.

FIG. 17 is a schematic diagram illustrating a pixel array of the image display panel according to the fourth embodiment. In the image display panel 40*b*, a pixel 48*b*S and a pixel 48*b*U configure a set of pixels 48*b* (pixel unit), and P×Q pixels 48*b* (pixel units) (P pixels in the row direction and Q pixels in the column direction) are arranged in a 2D matrix form.

In the fourth embodiment, the pixel 48*b*S and the pixel 48*b*U are alternately arranged in the Y direction (the column direction). The pixel 48*a*S and the pixel 48*a*U are consecutively arranged in the X direction (the row direction). For example, the pixel 48*b*S and the pixel 48*b*U may be alternately arranged even in the X direction.

The pixel 48*b*S includes a first sub pixel 49*b*SB, a second sub pixel 49*b*SW, and a third sub pixel 49*b*SG as illustrated in FIG. 17. In the pixel 48*b*S, the first sub pixel 49*b*SB, the third sub pixel 49*b*SG, and the second sub pixel 49*b*SW are arranged in the X direction in a stripe form in the described order. In the pixel 48*b*S, the third sub pixel 49*b*SG extends in the Y direction further than the other sub pixels. In the pixel 48*b*S, a space portion 55*b*S in which no sub pixel is arranged is formed between the third sub pixel 49*b*SG and the second sub pixel 49*b*SW, and the third sub pixel 49*b*SG and the second sub pixel 49*b*SW are not adjacent in the X direction.

More specifically, the first sub pixel 49*b*SB is arranged at one end portion of the pixel 48*b*S in the X direction. The first sub pixel 49*b*SB extends from one end portion 62*b*S serving as an end portion at the side opposite to the pixel 48*b*U side in the Y direction to the other end portion 63*b*S. The first sub pixel 49*b*SB has a rectangular shape.

The second sub pixel 49*b*SW is arranged at the other end portion of the pixel 48*b*S in the X direction. The second sub pixel 49*b*SW extends from one end portion 64*b*S serving as an end portion at the side opposite to the pixel 48*b*U side in the Y direction to the other end portion 65*b*S. One end portion 64*b*S of the second sub pixel 49*b*SW and one end portion 62*b*S of the first sub pixel 49*b*SB are at the same position in the Y direction. The other end portion 65*b*S of the second sub pixel 49*b*SW and the other end portion 63*b*S of the first sub pixel 49*b*SB are at the same position in the Y direction. Thus, the second sub pixel 49*b*SW and the first sub pixel 49*b*SB are arranged in the X direction. The second sub pixel 49*b*SW has the same shape as the first sub pixel 49*b*SB, that is, has the rectangular shape.

The third sub pixel 49*b*SG is arranged between the first sub pixel 49*b*SB and the second sub pixel 49*b*SW. More specifically, the third sub pixel 49*b*SG is adjacent to the first sub pixel 49*b*SB in the X direction. The third sub pixel 49*b*SG extends from one end portion 66*b*S (a first end portion of the third sub pixel) serving as an end portion at the side opposite to the pixel 48*b*U side in the Y direction to the other end portion 67*b*S (a second end portion of the third sub pixel). One end portion 66*b*S of the third sub pixel 49*b*SG is between the first sub pixel 49*b*SB and the second sub pixel 49*b*SW. In the fourth embodiment, one end portion 66*b*S of the third sub pixel 49*b*SG, one end portion 62*b*S of the first sub pixel 49*b*SB, and one end portion 64*b*S of the second sub pixel 49*b*SW are arranged in the X direction and at the same position in the Y direction. The other end portion 67*b*S of the third sub pixel 49*b*SG is positioned at the pixel 48*b*U side in the Y direction further than the other end portion 63*b*S of the first sub pixel 49*b*SB and the other end portion 65*b*S of the second sub pixel 49*b*SW. The third sub pixel 49*b*SG has the rectangular shape.

The space portion 55*b*S in which no sub pixel is arranged is disposed between the second sub pixel 49*b*SW and the third sub pixel 49*b*SG. In other words, the second sub pixel 49*b*SW is not adjacent to the third sub pixel 49*b*SG.

The pixel 48*b*U includes a first sub pixel 49*b*UB, a second sub pixel 49*b*UW, and a fourth sub pixel 49*b*UR as illustrated in FIG. 17. In the pixel 48*b*U, the first sub pixel 49*b*UB, the fourth sub pixel 49*b*UR, and the second sub pixel 49*b*UW are arranged in the X direction in a stripe form in the described order. In the pixel 48*b*U, the fourth sub pixel 49*b*UR extends in the Y direction further than the other sub pixels. In the pixel 48*b*U, a space portion 55*b*U in which no sub pixel is arranged is formed between the fourth sub pixel 49*b*UR and the first sub pixel 49*b*UB, and the fourth sub pixel 49*b*UR is not adjacent to the first sub pixel 49*b*SB in the X direction.

More specifically, the first sub pixel 49*b*UB is arranged at one end portion of the pixel 48*b*U in the X direction. The first sub pixel 49*b*UB extends from one end portion 62*b*U serving as an end portion at the side opposite to the pixel 48*b*S side in the Y direction to the other end portion 63*b*U. The first sub pixel 49*b*UB is adjacent to the first sub pixel 49*b*SB of the pixel 48*b*S in the Y direction. The first sub pixel 49*b*UB has the same shape as the first sub pixel 49*b*SB of the pixel 48*b*S, that is, has the rectangular shape.

The second sub pixel 49*b*UW is arranged at the other end portion of the pixel 48*b*U in the X direction. The second sub pixel 49*b*UW extends from one end portion 64*b*U serving as an end portion at the side opposite to the pixel 48*b*S side in the Y direction to the other end portion 65*b*U. One end portion 64*b*U of the second sub pixel 49*b*UW is at the same position as one end portion 62*b*U of the first sub pixel 49*b*UB in the Y direction. The other end portion 65*b*U of the second sub pixel 49*b*UW is at the same position as the other end portion 63*b*U of the first sub pixel 49*b*UB in the Y direction. Thus, the second sub pixel 49*b*UW and the first sub pixel 49*b*UB are arranged in the X direction. The second sub pixel 49*b*UW is adjacent to the second sub pixel 49*b*SW of the pixel 48*b*S in the Y direction. The second sub pixel 49*b*UW has the same shape as the first sub pixel 49*b*UB, that is, has the rectangular shape.

The fourth sub pixel 49*b*UR is arranged between the first sub pixel 49*b*UB and the second sub pixel 49*b*UW. More specifically, the fourth sub pixel 49*b*UR is adjacent to the second sub pixel 49*b*UW in the X direction. The fourth sub pixel 49*b*UR extends from one end portion 66*b*U (a first end portion of the fourth sub pixel) serving as an end portion at the side opposite to the pixel 48*b*S side in the Y direction to the other end portion 67*b*U (a second end portion of the fourth sub pixel). One end portion 66*b*U of the fourth sub pixel 49*b*UR is between the first sub pixel 49*b*UB and the second sub pixel 49*b*UW. In the fourth embodiment, one end portion 66*b*U of the fourth sub pixel 49*b*UR, one end portion 62*b*U of the first sub pixel 49*b*UB, and one end portion 64*b*U of the second sub pixel 49*b*UW are arranged in the X direction and at the same position in the Y direction. The other end portion 67$b$U of the fourth sub pixel 49$b$UR is positioned at the pixel 48$b$S side in the Y direction further than the other end portion 63$b$U of the first sub pixel 49$b$UB and the other end portion 65$b$U of the second sub pixel 49$b$UW.

The fourth sub pixel 49$b$UR extends in the space portion 55$b$S of the pixel 48$b$S from a middle portion 68$b$U which is at the same position as the other end portion 63$b$U of the first sub pixel 49$b$UB and the other end portion 65$b$U of the second sub pixel 49$b$UW in the Y direction to the other end portion 67$b$U. A portion of the fourth sub pixel 49$b$UR from the middle portion 68$b$U to the other end portion 67$b$U is adjacent to the second sub pixel 49$b$SW of the pixel 48$b$S and the third sub pixel 49$b$SG of the pixel 48$b$S in the X direction. The other end portion 67$b$U of the fourth sub pixel 49$b$UR, one end portion 64$b$S of the second sub pixel 49$b$SW of the pixel 48$b$S, and one end portion 66$b$S of the third sub pixel 49$b$SG of the pixel 48$b$S are arranged in the X direction and arranged at the same position in the Y direction. The fourth sub pixel 49$b$UR has the same shape as the third sub pixel 49$b$SG, that is, has the rectangular shape.

The space portion 55$b$U in which no sub pixel is arranged is disposed between the second sub pixel 49$b$SW and the fourth sub pixel 49$b$UR. In other words, the second sub pixel 49$b$SW is not adjacent to the fourth sub pixel 49$b$UR.

The third sub pixel 49$b$SG of the pixel 48$b$S extends in the space portion 55$b$U of the pixel 48$b$U from a middle portion 68$b$S which is at the same position as the other end portion 63$b$S of the first sub pixel 49$b$SB and the other end portion 65$b$S of the second sub pixel 49$b$SW in the Y direction to the other end portion 67$b$S. A portion of the third sub pixel 49$b$SG from the middle portion 68$b$S to the other end portion 67$b$S is adjacent to the first sub pixel 49$b$UB of the pixel 48$b$U to the fourth sub pixel 49$b$UR of the pixel 48$b$U in the X direction. The other end portion 67$b$S of the third sub pixel 49$b$SG, one end portion 62$b$U of the first sub pixel 49$b$UB of the pixel 48$b$U, and one end portion 66$b$U of the fourth sub pixel 49$b$UR of the pixel 48$b$U are arranged in the X direction and arranged at the same position in the Y direction.

The image display panel 40$b$ according to the fourth embodiment has the above-described pixel array. The region of the first sub pixel 49$b$SB and the second sub pixel 49$b$SW of the pixel 48$b$S, the region from one end portion 66$b$S of the third sub pixel 49$b$SG of the pixel 48$b$S to the middle portion 68$b$S, and the region from the middle portion 68$b$U of the fourth sub pixel 49$b$UR of the pixel 48$b$U to the other end portion 67$b$U thereof are positioned in a pixel display region 50$b$S as illustrated in FIG. 17. The region of the first sub pixel 49$b$UB and the second sub pixel 49$b$UW of the pixel 48$b$U, the region from the middle portion 68$b$S of the third sub pixel 49$b$SG of the pixel 48$b$S to the other end portion 67$b$S thereof, and the region from one end portion 66$b$U of the fourth sub pixel 49$b$UR of the pixel 48$b$U to the middle portion 68$b$U are positioned in a pixel display region 50$b$U.

As described above, in the image display panel 40$b$ according to the fourth embodiment, the regions of one parts of the third sub pixel 49G and the fourth sub pixel 49R are arranged in the pixel display region 50$b$S, and the regions of the other parts thereof are arranged in the pixel display region 50$b$U. Thus, the image display panel 40$b$ according to the fourth embodiment can suppress deterioration of an image, similarly to the image display panel 40 according to the first embodiment.

Fifth Embodiment

Next, a fifth embodiment will be described. A display device 10$c$ according to the fifth embodiment differs from the display device 10$b$ according to the fourth embodiment in that a first sub pixel 49$c$B and a second sub pixel 49$c$W in a pixel array of an image display panel 40$c$ are adjacent, unlike the image display panel 40$b$. The display device 10$c$ according to the fifth embodiment has the same configuration as the display device 10$b$ according to the fourth embodiment in the other points, and a description thereof is not repeated.

Figure 18:
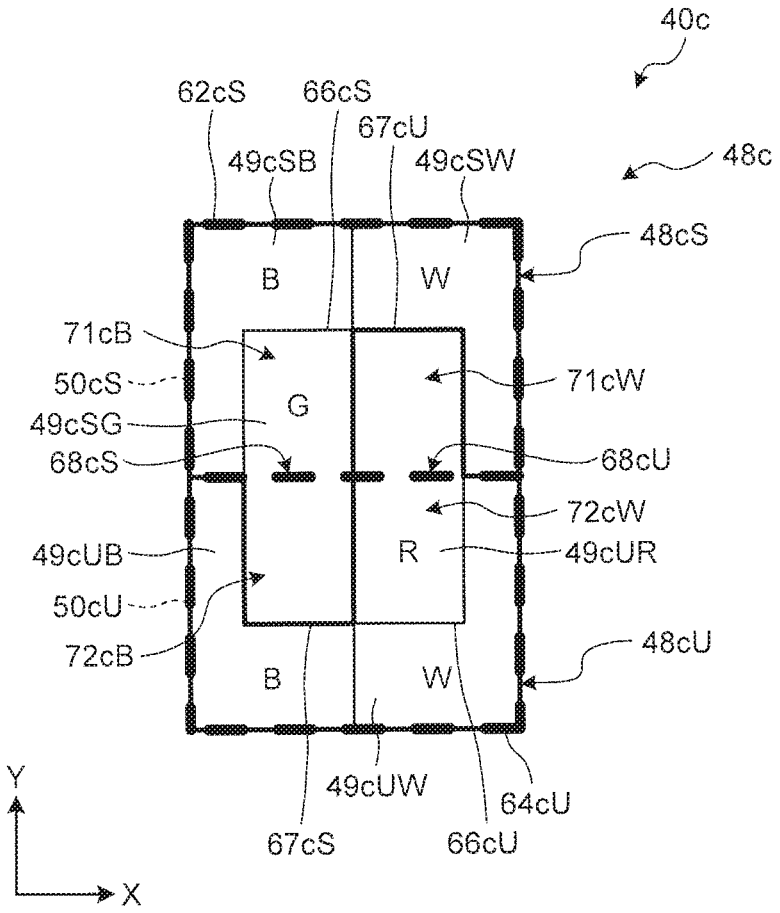
FIG. 18 is a schematic diagram illustrating a pixel array of an image display panel according to a fifth embodiment.

FIG. 18 is a schematic diagram illustrating a pixel array of an image display panel according to the fifth embodiment. In the image display panel 40$c$, a pixel 48$c$S and a pixel 48$c$U configure a set of pixels 48$c$ (pixel unit), and P×Q pixels 48$c$ (pixel units) (P pixels in the row direction and Q pixels in the column direction) are arranged in a 2D matrix form.

The pixel 48$c$S includes a first sub pixel 49$c$SB, a second sub pixel 49$c$SW, and a third sub pixel 49$c$SG. The first sub pixel 49$c$SB is arranged at one end portion of the pixel 48$c$S in the X direction. The first sub pixel 49$c$SB includes a space portion 71$c$B of a rectangular shape at one apex portion of a rectangle, and has a letter L shape formed by cutting out the space portion 71$c$B from the rectangle.

The second sub pixel 49$c$SW is arranged at the other end portion of the pixel 48$c$S in the X direction. The second sub pixel 49$c$SW includes a space portion 71$c$W of a rectangular shape at one apex portion of a rectangle, and has a letter L shape formed by cutting out the space portion 71$c$W from the rectangle. The second sub pixel 49$c$SW and the first sub pixel 49$c$SB are adjacent to each other at the sides of the space portions 71$c$B and 71$c$W in the X direction.

The third sub pixel 49$c$SG is arranged between the first sub pixel 49$c$SB and the second sub pixel 49$c$SW. More specifically, the third sub pixel 49$c$SG is arranged in the space portion 71$c$B of the first sub pixel 49$c$SB, and extends from one end portion 66$c$S to the other end portion 67$c$S via a middle portion 68$c$S in the Y direction. One end portion 66$c$S of the third sub pixel 49$c$SG is positioned at the pixel 48$c$U side in the Y direction further than one end portion 62$c$S of the first sub pixel 49$c$SB. The third sub pixel 49$c$SG is adjacent to the first sub pixel 49$c$SB in the X direction and the Y direction. The third sub pixel 49$c$SG has the rectangular shape.

The pixel 48$c$U includes a first sub pixel 49$c$UB, a second sub pixel 49$c$UW, and a fourth sub pixel 49$c$UR. The first sub pixel 49$c$UB is arranged at one end portion of the pixel 48$c$U in the X direction. The first sub pixel 49$c$UB includes a space portion 72$c$B at one apex portion of a rectangle, and has a letter L shape formed by cutting out the space portion 72$c$B from the rectangle.

The second sub pixel 49$c$UW is arranged at the other end portion of the pixel 48$c$U in the X direction. The second sub pixel 49$c$UW includes a space portion 72$c$W at one apex portion of a rectangle, and has a letter L shape formed by cutting out the space portion 72$c$W from the rectangle. The second sub pixel 49$c$UW is adjacent to the first sub pixel 49$c$UB in the sides of the space portions 72$c$B and 72$c$W in the X direction.

The fourth sub pixel 49$c$UR is arranged between the first sub pixel 49$c$UB and the second sub pixel 49$c$UW. More specifically, the fourth sub pixel 49$c$UR is arranged in the space portion 72$c$W of the second sub pixel 49$c$UW, and extends from one end portion 66$c$U to the other end portion 67$c$U via a middle portion 68$c$U in the Y direction. One end portion 66$c$U of the fourth sub pixel 49$c$UR is positioned at the pixel 48$c$S side in the Y direction further than one end portion 64$c$U of the second sub pixel 49$c$UW. The fourth sub pixel 49$c$UR is adjacent to the second sub pixel 49$c$UW in the X direction and the Y direction. The fourth sub pixel 49$c$UR has the rectangular shape.

The fourth sub pixel 49$c$UR extends from the middle portion 68$c$U to the other end portion 67$c$U in the space portion 71$c$W of the second sub pixel 49$c$SW of the pixel 48$c$S. The fourth sub pixel 49$c$UR is adjacent to the second sub pixel 49$c$SW of the pixel 48$c$S at the other end portion 67$c$U in the Y direction. A portion of the fourth sub pixel 49$c$UR from the middle portion 68$c$U to the other end portion 67$c$U is adjacent to the second sub pixel 49$c$SW of the pixel 48$c$S in the X direction.

The third sub pixel 49$c$SG of the pixel 48$c$S extends from the middle portion 68$c$S to the other end portion 67$c$S in the space portion 72$c$B of the first sub pixel 49$c$UB of the pixel 48$c$U. The third sub pixel 49$c$SG is adjacent to the first sub pixel 49$c$UB of the pixel 48$c$U at the other end portion 67$c$S in the Y direction. A portion of the third sub pixel 49$c$SG from the middle portion 68$c$S to the other end portion 67$c$S is adjacent to the first sub pixel 49$c$UB of the pixel 48$c$U in the X direction. The third sub pixel 49$c$SG is adjacent to the fourth sub pixel 49$c$UR of the pixel 48$c$U in the X direction.

The image display panel 40$c$ according to the fifth embodiment has the above-described pixel array. As illustrated in FIG. 18, the region of the first sub pixel 49$c$SB and the second sub pixel 49$c$SW of the pixel 48$c$S, the region from one end portion 66$c$S of the third sub pixel 49$c$SG of the pixel 48$c$S to the middle portion 68$c$S, and the region from the middle portion 68$c$U of the fourth sub pixel 49$c$UR of the pixel 48$c$U to the other end portion 67$c$U thereof are positioned in a pixel display region 50$c$S. The region of the first sub pixel 49$c$UB and the second sub pixel 49$c$UW of the pixel 48$c$U, the region from the middle portion 68$c$S of the third sub pixel 49$c$SG of the pixel 48$c$S to the other end portion 67$c$S thereof, and the region from one end portion 66$c$U of the fourth sub pixel 49$c$UR of the pixel 48$c$U to the middle portion 68$c$U are positioned in a pixel display region 50$c$U.

As described above, in the image display panel 40$c$ according to the fifth embodiment, the regions of one parts of the third sub pixel 49G and the fourth sub pixel 49R are arranged in the pixel display region 50$c$S, and the regions of the other parts thereof are arranged in the pixel display region 50$c$U. Thus, the image display panel 40$c$ according to the fifth embodiment can suppress deterioration of an image, similarly to the image display panel 40 according to the first embodiment.

Sixth Embodiment

Next, a sixth embodiment will be described. A display device 10$d$ according to the sixth embodiment differs from the display device 10$c$ according to the fifth embodiment in that the shape of each sub pixel in a pixel array of an image display panel 40$d$ differs from that of the image display panel 40$c$. The display device 10$d$ according to the sixth embodiment has the same configuration as the display device 10$c$ according to the fifth embodiment in the other points, and thus a description thereof is not repeated.

Figure 19:
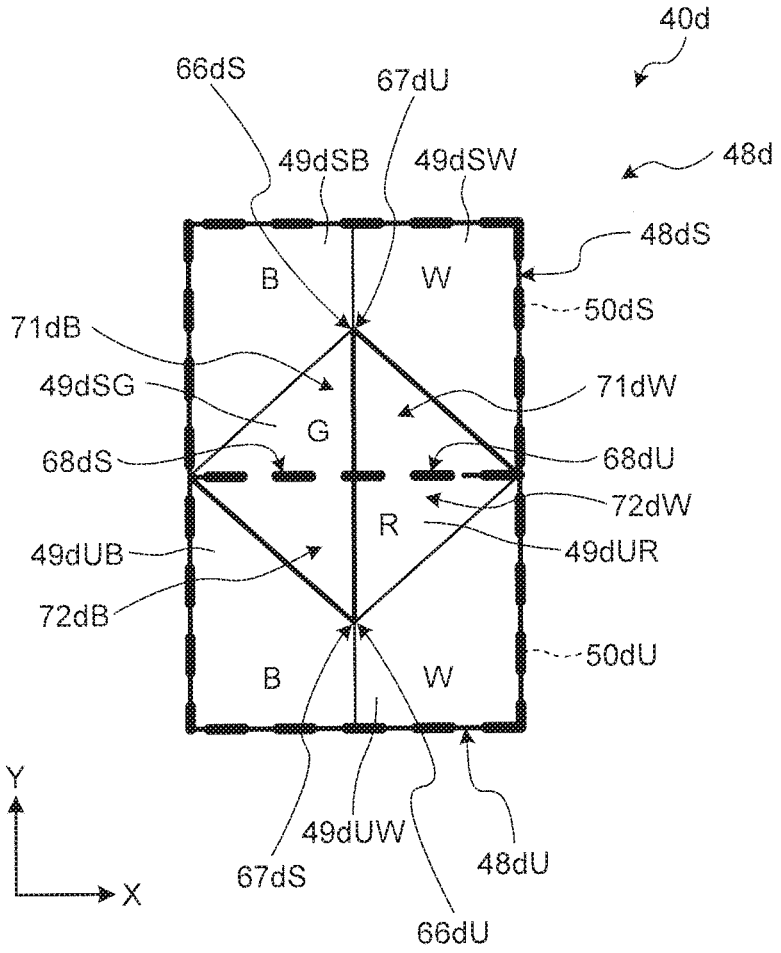
FIG. 19 is a schematic diagram illustrating a pixel array of an image display panel according to a sixth embodiment.

FIG. 19 is a schematic diagram illustrating a pixel array of the image display panel according to the sixth embodiment. In the image display panel 40$d$, a pixel 48$d$S and a pixel 48$d$U configure a set of pixels 48$d$ (pixel unit), and P×Q pixels 48$d$ (pixel units) (P pixels in the row direction and Q pixels in the column direction) are arranged in a 2D matrix form. A pixel 48$d$S includes a first sub pixel 49$d$SB, a second sub pixel 49$d$SW, and a third sub pixel 49$d$SG as illustrated in FIG. 19. A space portion 71$d$B of the first sub pixel 49$d$SB has the triangular shape. The space portion 71$d$W of the second sub pixel 49$d$SW has the triangular shape as well. The third sub pixel 49$d$SG extends in the Y-axis direction such that the width of the third sub pixel 49$d$SG increases from one end portion 66$d$S to a middle portion 68$d$S and decreases from the middle portion 68$d$S to the other end portion 67$d$S. The third sub pixel 49$d$SG has the triangular shape.

A pixel 48$d$U includes a first sub pixel 49$d$UB, a second sub pixel 49$d$UW, and a fourth sub pixel 49$d$UR. A space portion 72$d$B of the first sub pixel 49$d$UB has the triangular shape. A space portion 72$d$W of the second sub pixel 49$d$UW has the triangular shape as well. The fourth sub pixel 49$d$UR extends in the Y-axis direction such that the width of the fourth sub pixel 49$d$UR increases from one end portion 66$d$U to a middle portion 68$d$U and decreases from the middle portion 68$d$U to the other end portion 67$d$U. The fourth sub pixel 49$d$UR has the triangular shape.

As illustrated in FIG. 19, in the image display panel 40$d$ according to the sixth embodiment, the regions of one parts of the third sub pixel 49G and the fourth sub pixel 49R are arranged in a pixel display region 50$d$S, and the regions of the other parts thereof are arranged in a pixel display region 50$d$U. Thus, the image display panel 40$d$ according to the sixth embodiment can suppress deterioration of an image, similarly to the image display panel 40 according to the first embodiment.

As described above in the fourth to sixth embodiments, when the image display panel 40 has the pixel array in which the first sub pixel 49B and the second sub pixel 49W are arranged at both end portions of the pixel in the X direction, the shape of each sub pixel 49 is arbitrary as long as the regions of one parts of the third sub pixel 49G and the fourth sub pixel 49R are arranged in the pixel display region 50S, and the regions of the other parts thereof are arranged in the pixel display region 50U. The shapes of the sub pixels described in the fourth to sixth embodiments are examples.

Seventh Embodiment

Next, a seventh embodiment will be described. A display device 10$e$ according to the seventh embodiment differs from the display device 10 according to the first embodiment in that an array of sub pixels in the X direction in a pixel array of an image display panel 40$e$ is inclined in the Y direction unlike the image display panel 40. The display device 10$e$ according to the seventh embodiment has the same configuration as the display device 10 according to the first embodiment in the other points, and thus a description thereof is not repeated.

Figure 20:
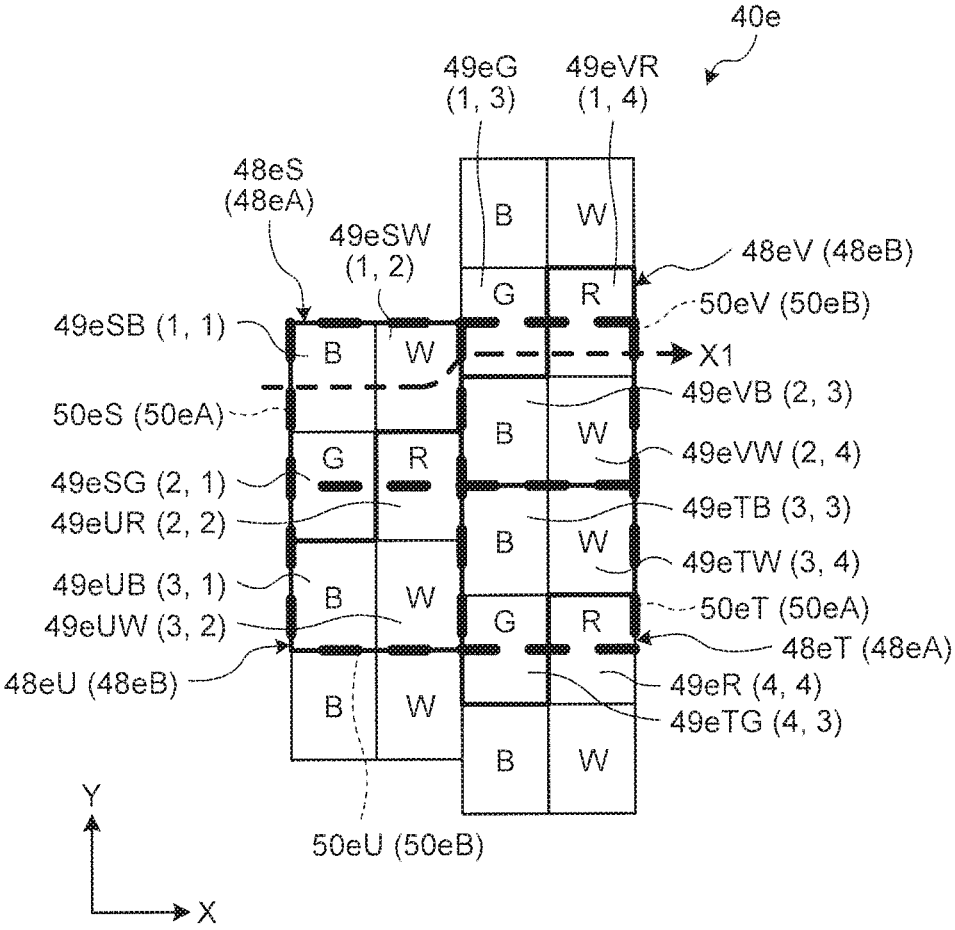
FIG. 20 is a schematic diagram illustrating a pixel array of an image display panel according to a seventh embodiment.

FIG. 20 is a schematic diagram illustrating a pixel array of the image display panel according to the seventh embodiment. A pixel 48$e$A and a pixel 48$e$B are alternately arranged in the Y direction (the column direction) as illustrated in FIG. 20. The pixel 48$e$A and the pixel 48$e$B are alternately arranged in the X direction (the row direction). An array in the X direction is inclined in the Y direction.

More specifically, the pixel 48$e$A includes a pixel 48$e$S and a pixel 48$e$T as illustrated in FIG. 20. The pixel 48$e$B includes a pixel 48$e$U and a pixel 48$e$V. The pixel 48$e$S is adjacent to the pixel 48$e$U in the Y direction and adjacent to the pixel 48eV in the X direction. The pixel 48eT is adjacent to the pixel 48eU in the X direction and adjacent to the pixel 48eV in the Y direction.

The pixel 48eS includes a first sub pixel 49eSB, a second sub pixel 49eSW, and a third sub pixel 49eSG. The pixel 48eT includes a first sub pixel 49eTB, a second sub pixel 49eTW, and a third sub pixel 49eTG. The pixel 48eU includes a first sub pixel 49eUB, a second sub pixel 49eUW, and a fourth sub pixel 49eUR. The pixel 48eV includes a first sub pixel 49eVB, a second sub pixel 49eVW, and a fourth sub pixel 49eVR.

The sub pixels 49e are arranged in the Y direction. The sub pixels 49e are arranged along a first column extending in the Y direction, a second column arranged in a column next to the first column, a third column arranged in a column next to the second column, and a fourth column arranged in a column next to the third column as illustrated in FIG. 20. The sub pixels 49e are arranged in the X direction as well, but the array is inclined in the Y direction as illustrated in FIG. 20. More specifically, the sub pixels 49e in the first column and the second column are arranged in the X direction. The sub pixels 49e in the third column and the fourth column are arranged in the X direction. However, the sub pixels 49e in the second column and the third column are arranged to be inclined in the Y direction. For example, the pixel 48eS includes a second sub pixel 49eSW(1,2) arranged in the second column as illustrated in FIG. 20. A region at a side opposite to the pixel 48eU in regions obtained by dividing the second sub pixel 49eSW(1,2) into two in the Y direction is adjacent to a region at the pixel 48eT sides in two regions divided in the Y direction in a third sub pixel 49eG(1,3) arranged in the third column in the X direction. The third sub pixel 49eG(1,3) and a fourth sub pixel 49eVR(1,4) of the pixel 48eV arranged in the fourth column are arranged in the X direction. In other words, the sub pixel 49e in the second column and the sub pixel 49e in the third column are arranged in the X direction but arranged to be inclined in the Y direction toward the upper side (the pixel 48eS side) in FIG. 20. For this reason, in the following description, an array X1 serving as an array in which the first sub pixel 49eSB(1,1), the second sub pixel 49eSW(1,2), the third sub pixel 49eG(1,3), and the fourth sub pixel 49eVR (1,4) are inclined in the X direction is referred to as a "first row". An array in which in a row next to the first row, the sub pixels adjacent to the sub pixels 49e in the first row toward the lower side (the pixel 48eU side) in FIG. 20 in the Y direction are inclined in the X direction is referred to as a "second row". Similarly, a row next to the second row is referred to as a "third row", and a row next to the third row is referred to as a "fourth row".

One part of the sub pixel 49e in the second column is adjacent to the sub pixel 49e in the same row, but the other part thereof is adjacent to the sub pixel 49e in the next row as well. For example, the second sub pixel 49eSW(1,2) is adjacent to the first sub pixel 49eVB(2,3) arranged in the second row and the third column as well. Next, an arrangement of each sub pixel 49e will be described in further detail.

The pixel 48eS includes a first sub pixel 49eSB(1,1), a second sub pixel 49eSW(1,2), and a third sub pixel 49eSG (2,1) as illustrated in FIG. 20. The pixel 48eU includes a first sub pixel 49eUB(3,1), a second sub pixel 49eUW(3,2), and a fourth sub pixel 49eUR(2,2). The pixel 48eV includes a first sub pixel 49eVB(2,3), a second sub pixel 49eVW(2,4), and a fourth sub pixel 49eVR(1,4). The pixel 48eT includes a first sub pixel 49eTB(3,3), a second sub pixel 49eTW(3,4), and a third sub pixel 49eTG(4,3).

A second row side region of two regions obtained by dividing the second sub pixel 49eSW(1,2) of the pixel 48eS into two in the Y direction is adjacent to a first row side region of two regions obtained by dividing the first sub pixel 49eVB(2,3) of the pixel 48eV into two in the Y direction.

A third row side region of two regions obtained by dividing the first sub pixel 49eVB(2,3) of the pixel 48eV into two in the Y direction is adjacent to a first row side region of two regions obtained by dividing the fourth sub pixel 49eUR(2,2) of the pixel 48eU into two in the Y direction.

A third row side region of two regions obtained by dividing the fourth sub pixel 49eUR(2,2) of the pixel 48eU into two in the Y direction is adjacent to a second row side region of two regions obtained by dividing the first sub pixel 49eTB(3,3) of the pixel 48eT into two in the Y direction.

A fourth row side region of two regions obtained by dividing the first sub pixel 49eTB(3,3) of the pixel 48eT into two in the Y direction is adjacent to a second row side region of two regions obtained by dividing the second sub pixel 49eUW(3,2) of the pixel 48eU into two in the Y direction.

A fourth row side region of two regions obtained by dividing the second sub pixel 49eUW(3,2) of the pixel 48eU into two in the Y direction is adjacent to a third row side region of two regions obtained by dividing the third sub pixel 49eTG(4,3) of the pixel 48eT into two in the Y direction.

A region in which the first sub pixel 49eSB(1,1) and the second sub pixel 49eSW(1,2) of the pixel 48eS are arranged, the first row side region of the regions obtained by dividing the third sub pixel 49eSG(2,1) of the pixel 48eS into two in the Y direction, and the first row side region of the regions obtained by dividing the fourth sub pixel 49eUR(2,2) of the pixel 48eU into two in the Y direction are arranged in a pixel display region 50eS as illustrated in FIG. 20.

A region in which the first sub pixel 49eTB(3,3) and the second sub pixel 49eTW(3,4) of the pixel 48eT are arranged, the third row side region of the regions obtained by dividing the third sub pixel 49eTG(4,3) of the pixel 48eT into two in the Y direction, and the third row side region of the regions obtained by dividing a fourth sub pixel 49eR(4,4) into two in the Y direction are arranged in a pixel display region 50eT.

A region in which the first sub pixel 49eUB(3,1) and the second sub pixel 49eUW(3,2) of the pixel 48eU are arranged, the third row side region of the regions obtained by dividing the third sub pixel 49eSG(2,1) of the pixel 48eS into two in the Y direction, and the third row side region of the regions obtained by dividing the fourth sub pixel 49eUR (2,2) of the pixel 48eU into two in the Y direction are arranged in a pixel display region 50eU.

A region in which the first sub pixel 49eVB(2,3) and the second sub pixel 49eVW(2,4) of the pixel 48eV are arranged, the second row side region of the regions obtained by dividing the third sub pixel 49eG(1,3) into two in the Y direction, and the second row side region of the regions obtained by dividing the fourth sub pixel 49eVR(1,4) of the pixel 48eV into two in the Y direction are arranged in a pixel display region 50eV.

As described above, even in the image display panel 40e according to the seventh embodiment, the regions of one parts of the third sub pixel 49eG and the fourth sub pixel 49eR are arranged in a pixel display region 50eA, and the regions of the other parts thereof are arranged in a pixel display region 50eB. Thus, even when an array of sub pixels is inclined as in the image display panel 40e according to the seventh embodiment, it is possible to suppress deterioration of an image, similarly to the image display panel 40 according to the first embodiment. The inclination of the array of sub pixels is not limited to the example described in the seventh embodiment, and a degree of inclination is arbitrary as long as the regions of one parts of the third sub pixel 49*e*G and the fourth sub pixel 49*e*R are arranged in the pixel display region 50*e*A, and the regions of the other parts thereof are arranged in the pixel display region 50*e*B.

Eighth Embodiment

Next, an eighth embodiment will be described. A display device 10*f* according to the eighth embodiment differs from the image display panel 40*a* according to the third embodiment in an array of a first sub pixel 49*f*B and a second sub pixel 49*f*W of an image display panel 40*e*. The display device 10*f* according to the eighth embodiment has the same configuration as the display device 10*a* according to the third embodiment in the other points, and thus a description thereof is not repeated.

Figure 21:
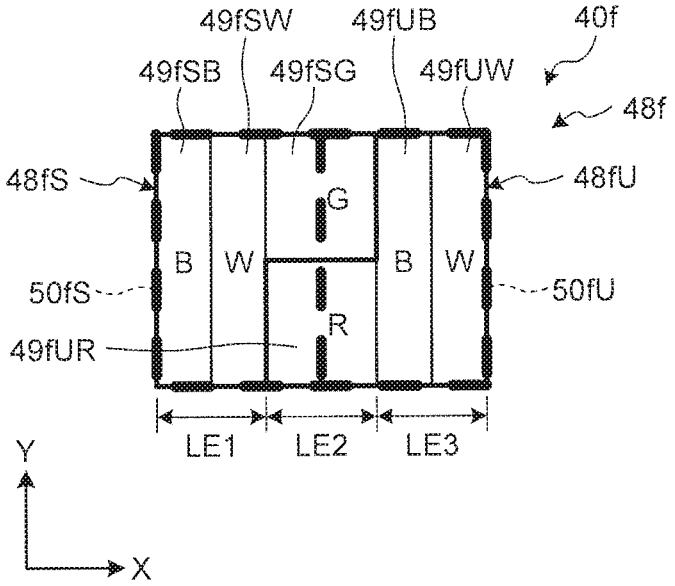
FIG. 21 is a schematic diagram illustrating a pixel array of an image display panel according to an eighth embodiment.

FIG. 21 is a schematic diagram illustrating a pixel array of an image display panel according to the eighth embodiment. In the image display panel 40*f*, a pixel 48*f*S and a pixel 48*f*U configure a set of pixels 48*f* (pixel unit), and P×Q pixels 48*f* (pixel units) (P pixels in the row direction and Q pixels in the column direction) are arranged in a 2D matrix form. An image display panel 40*f* according to the eighth embodiment includes a pixel 48*f*S and a pixel 48*f*U as illustrated in FIG. 21. The pixel 48*f*S includes a first sub pixel 49*f*SB, a second sub pixel 49*f*SW, and a third sub pixel 49*f*SG. The pixel 48*f*U includes a first sub pixel 49*f*UB, a second sub pixel 49*f*UW, and a fourth sub pixel 49*f*UR.

In the pixel 48*f*S, the first sub pixel 49*f*SB, the second sub pixel 49*f*SW, and the third sub pixel 49*f*SG are arranged in the X direction in the described order. In other words, in the pixel 48*f*S, the first sub pixel 49*f*SB is arranged in the first column, the second sub pixel 49*f*SW is arranged in the second column, and the third sub pixel 49*f*SG is arranged in the third column. More specifically, the first sub pixel 49*f*SB and the second sub pixel 49*f*SW are arranged to be adjacent to each other in a stripe form.

The third sub pixel 49*f*SG is arranged to be adjacent to one (the upper side in FIG. 21) of regions obtained by dividing the second sub pixel 49*f*SW into two in the Y direction in the X direction. In other words, the third sub pixel 49*f*SG is smaller in the length in the Y direction than the first sub pixel 49*f*SB and the second sub pixel 49*f*SW. A length LE2 of the third sub pixel 49*f*SG in the X direction is larger than the length of the first sub pixel 49*f*SB and the second sub pixel 49*f*SW in the X direction. The length LE2 of the third sub pixel 49*f*SG in the X direction is the same as a length LE1 obtained by adding the length of the first sub pixel 49*f*SB to the length of the second sub pixel 49*f*SW in the X direction. The lengths of the first sub pixel 49*f*SB, the second sub pixel 49*f*SW, and the third sub pixel 49*f*SG in the X direction are not limited to this example and are arbitrary.

In the pixel 48*f*U, the fourth sub pixel 49*f*UR, the first sub pixel 49*f*UB, and the second sub pixel 49*f*UW are arranged in the X direction in the described order. In other words, in the pixel 48*f*U, the fourth sub pixel 49*f*UR is arranged in the third column, the first sub pixel 49*f*UB is arranged in the fourth column, and the second sub pixel 49*f*UW is arranged in the fifth column. More specifically, the first sub pixel 49*f*UB and the second sub pixel 49*f*UW are arranged to be adjacent to each other in a stripe form.

The fourth sub pixel 49*f*UR and one (the lower side in FIG. 21) of regions obtained by dividing the first sub pixel 49*f*UB into two in the Y direction are arranged to be adjacent to each other in the X direction. In other words, the fourth sub pixel 49*f*UR is smaller in the length in the Y direction than the first sub pixel 49*f*UB and the second sub pixel 49*f*UW. The length of the fourth sub pixel 49*f*UR in the X direction is the length LE2 of the third sub pixel 49*f*SG in the X direction. The length of the fourth sub pixel 49*f*UR in the X direction (the length LE2 of the third sub pixel 49*f*SG in the X direction) is larger than the length of the first sub pixel 49*f*UB and the second sub pixel 49*f*UW in the X direction. The length of the fourth sub pixel 49*f*UR in the X direction (the length LE2 of the third sub pixel 49*f*SG in the X direction) is the same as a length LE3 obtained by adding the length of the first sub pixel 49*f*UB to the length of the second sub pixel 49*f*UW in the X direction. The lengths of the first sub pixel 49*f*UB, the second sub pixel 49*f*UW, and the fourth sub pixel 49*f*UR in the X direction are not limited to this example and are arbitrary.

The third sub pixel 49*f*SG of the pixel 48*f*S and the other region (the upper side in FIG. 21) of regions obtained by dividing the first sub pixel 49*f*UB of the pixel 48*f*U into two in the Y direction are adjacent to each other in the X direction at an end portion on a side opposite to the second sub pixel 49*f*SW side. The fourth sub pixel 49*f*UR of the pixel 48*f*U and the other region (the lower side in FIG. 21) of regions obtained by dividing the second sub pixel 49*f*SW of the pixel 48*f*S into two in the Y direction are arranged to be adjacent to each other in the X direction at an end portion on a side opposite to the first sub pixel 49*f*UB side. The third sub pixel 49*f*SG of the pixel 48*f*S and the fourth sub pixel 49*f*UR of the pixel 48*f*U are adjacent to each other in the Y direction.

The region in which the first sub pixel 49*f*SB and the second sub pixel 49*f*SW of the pixel 48*f*S are arranged, the second sub pixel 49*f*SW side region of the regions obtained by dividing the third sub pixel 49*f*SG of the pixel 48*f*S into two in the X direction, and the second sub pixel 49*f*SW side region of the regions obtained by dividing the fourth sub pixel 49*f*UR of the pixel 48*f*U into two in the X direction are arranged in a pixel display region 50*f*S. The region in which the first sub pixel 49*f*UB and the second sub pixel 49*f*UW of the pixel 48*f*U are arranged, the first sub pixel 49*f*UB side region of the regions obtained by dividing the third sub pixel 49*f*SG of the pixel 48*f*S into two in the X direction, and the first sub pixel 49*f*UB side region of the regions obtained by dividing the fourth sub pixel 49*f*UR of the pixel 48*f*U into two in the X direction are arranged in a pixel display region 50*f*U.

As described above, in the image display panel 40*f* according to the eighth embodiment, the regions of one parts of a third sub pixel 49*f*G and a fourth sub pixel 49*f*R are arranged in the pixel display region 50*f*S, and the regions of the other parts thereof are arranged in the pixel display region 50*f*U. Thus, the image display panel 40*f* according to the eighth embodiment can suppress deterioration of an image, similarly to the image display panel 40 according to the first embodiment. As described above, an arrangement of each sub pixel can be arbitrarily selected as long as the regions of one parts of the third sub pixel 49*f*G and the fourth sub pixel 49*f*R are arranged in the pixel display region 50*f*S, and the regions of the other parts thereof are arranged in the pixel display region 50*f*U. For example, the first sub pixel 49*f*B and the second sub pixel 49*f*W may be arranged in a stripe form as described in the eighth embodiment.

First Modification

The display device 10 according to the first embodiment described above is a reflective liquid crystal display device. The pixel array of the image display panel 40 according to the first embodiment described above can be applied even to any other type of image display device. A display device 10*g* according to the first modification is a transmissive liquid crystal display device.

Figure 22:
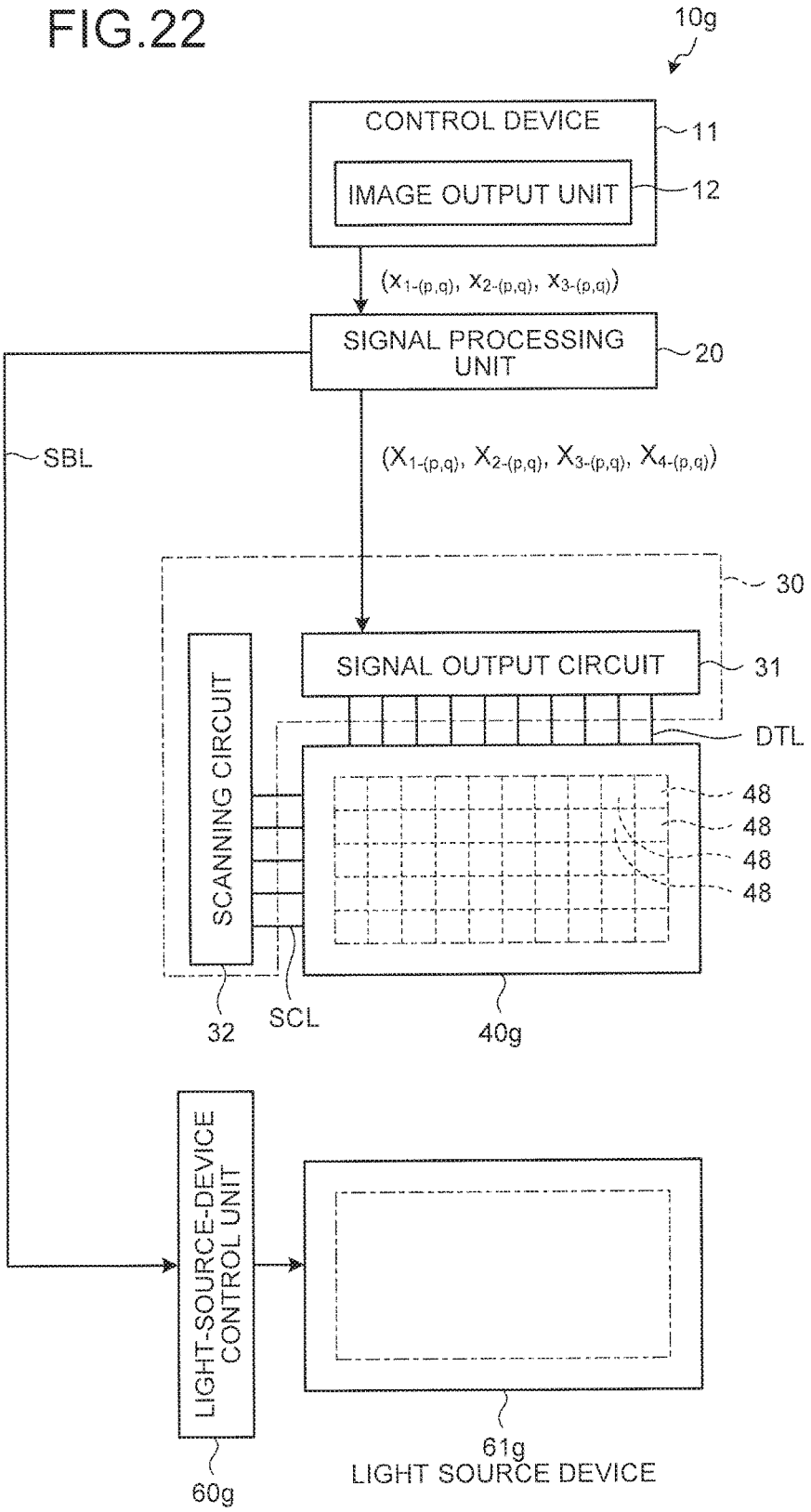
FIG. 22 is a block diagram illustrating an example of a configuration of a display device according to a first modification.

FIG. 22 is a block diagram illustrating an example of a configuration of the display device according to the first modification. The display device 10*g* according to the first modification includes the signal processing unit 20, the image-display-panel driving unit 30, an image display panel 40*g*, a light-source-device control unit 60*g*, and a light source device 61*g* as illustrated in FIG. 22. The signal processing unit 20 transfers a signal to the respective units of the display device 10*g*, the image-display-panel driving unit 30 controls driving of the image display panel 40*g* based on the signal received from the signal processing unit 20, the image display panel 40*g* displays an image based on a signal received from the image-display-panel driving unit 30, the light-source-device control unit 60*g* controls driving of the light source device 61*g* based on the signal received from the signal processing unit 20, and the light source device 61*g* illuminates the image display panel 40*g* from the back surface based on a signal of the light-source-device control unit 60*g*. Thus, the display device 10*g* displays an image.

The light source device 61*g* is arranged at the back surface side of the image display panel 40*g*, and light is emitted toward the image display panel 40*g* according to control of the light-source-device control unit 60*g* to illuminate the image display panel 40*g*, so that an image is displayed. The light source device 61*g* emits light toward the image display panel 40*g* to make the image display panel 40*g* brighter.

The light-source-device control unit 60*g* controls, for example, a quantity of light output from the light source device 61*g*. Specifically, the light-source-device control unit 60*g* controls a quantity of light (intensity of light) illuminating the image display panel 40*g* by adjusting, for example, a voltage supplied to the light source device 61*g* according to a pulse width modulation (PWM) based on a light-source-device control signal SBL output from a signal processing unit 20*g*.

The display device 10*g* calculates the expansion coefficient $\alpha$ from the corrected input signal by performing the same expansion process as in the display device 10 according to the first embodiment, and generates the output signal from the input signal and the expansion coefficient $\alpha$.

In the display device 10*g*, the output signal is expanded $\alpha$ times. In order to cause illuminance of an image to be the same as luminance of an image in a non-expanded state, there are cases in which the display device 10*g* reduces the luminance of the light source device 61*g* based on the expansion coefficient $\alpha$. Specifically, the display device 10*g* causes the luminance of the light source device 61*g* to be $(1/\alpha)$ times. As a result, the display device 10*g* can reduce the power consumption of the light source device 61*g*. The signal processing unit 20 outputs $(1/\alpha)$ to the light-source-device control unit 60*g* as the light-source-device control signal SBL.

The image display panel according to the first embodiment employs a so-called RG thinning configuration in which each pixel includes neither the third sub pixel 49G nor the fourth sub pixel 49R. On the other hand, in the first modification, the image display panel 40*g* employs a so-called BW thinning configuration in which there is neither the first sub pixel 49B nor the second sub pixel 49W. It is possible to select a sub pixel that is not arranged in each pixel arbitrarily.

Second Modification

The pixel array of the image display panel 40 according to the first embodiment can be applied even to a light-emitting image display device. A display device 10*h* according to the second modification includes a light-emitting image display panel 40*h* employing an organic light-emitting diode (OLED).

Figure 23:
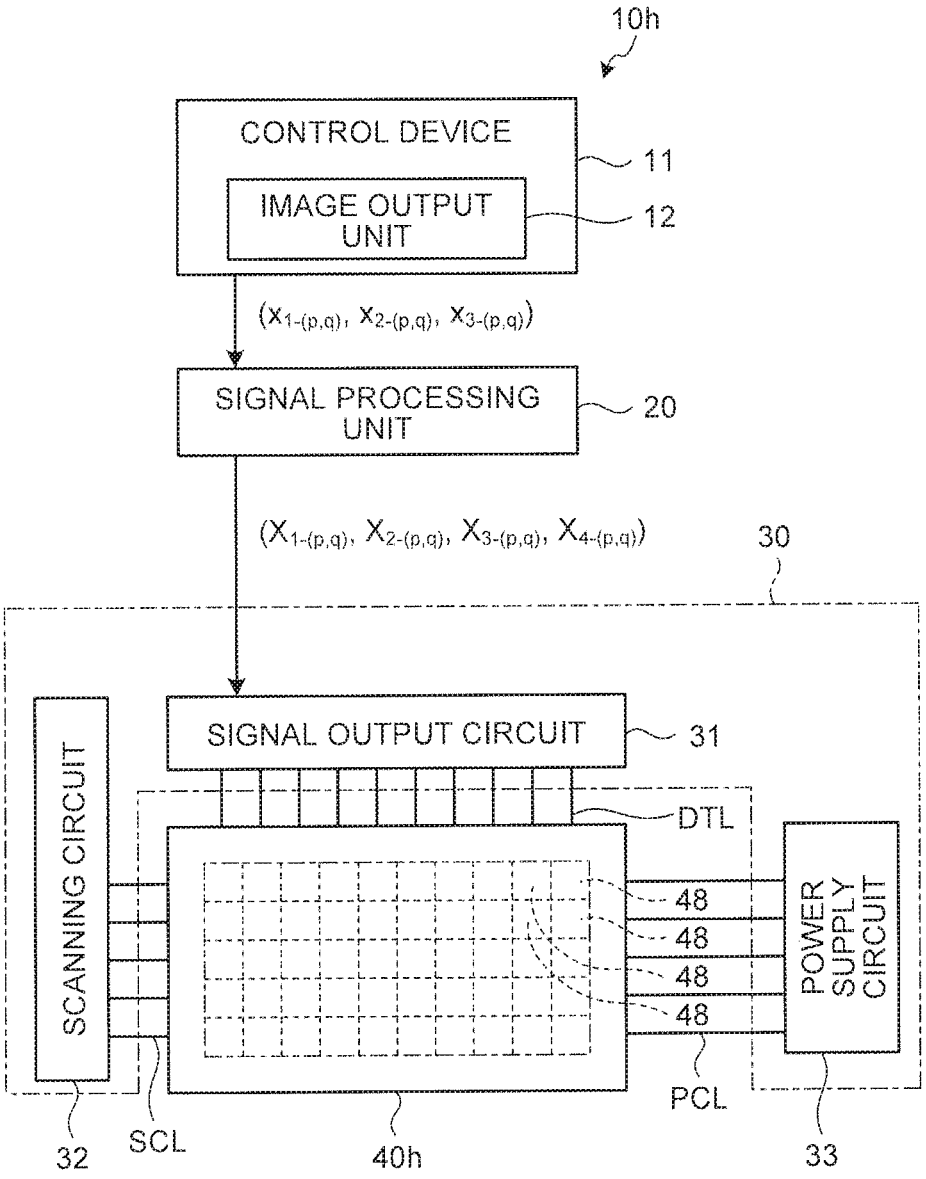
FIG. 23 is a block diagram illustrating an example of a configuration of a display device according to a second modification.
Figure 24:
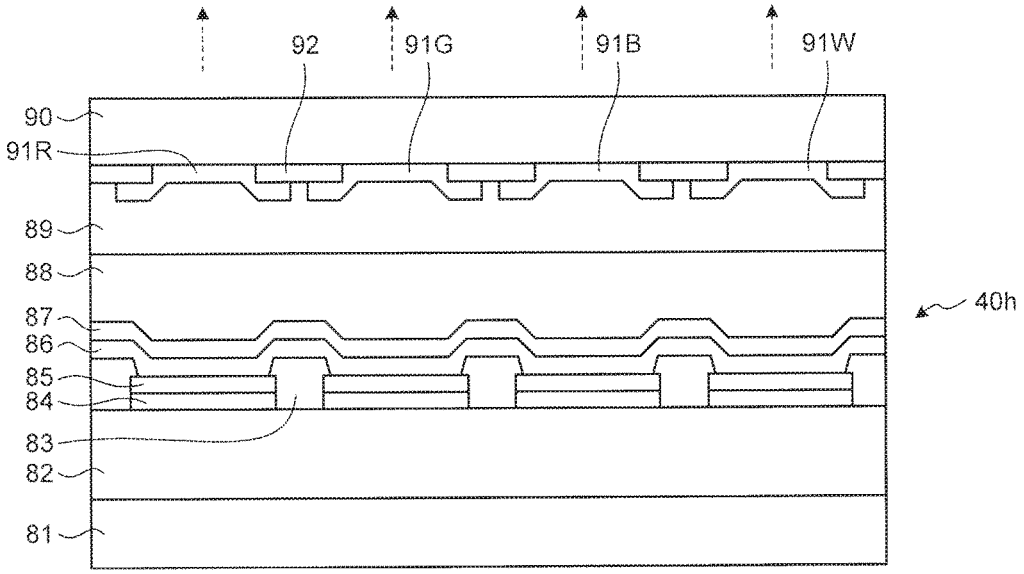
FIG. 24 is a cross-sectional view schematically illustrating a structure of an image display panel according to a second modification.

FIG. 23 is a block diagram illustrating an example of a configuration of a display device according to a second modification. FIG. 24 is a cross-sectional view schematically illustrating a structure of an image display panel according to the second modification. The display device 10*h* according to the second modification includes a power supply circuit 33 and an image display panel 40*h* as illustrated in FIG. 23. The power supply circuit 33 supplies electric power to a light-emitting layer which will be described later through a power line PCL.

The image display panel 40*h* includes a substrate 81, insulating layers 82 and 83, a reflecting layer 84, a lower electrode 85, a light-emitting layer 86, an upper electrode 87, an insulating layer 88, an insulating layer 89, color filters 91B, 91W, 91G, and 91R, a black matrix 92, and a substrate 90 as illustrated in FIG. 24. The substrate 81 is a substrate on which the respective components of the image display panel 40*h* are formed or held. The insulating layer 82 is a passivation film having an insulation property for protecting an electrode and the like. The insulating layer 83 is an insulating layer that is called a bank and divides the respective sub pixels 49. The reflecting layer 84 reflects light from the light-emitting layer 86. A voltage is applied from the power supply circuit 33 to the lower electrode 85 and the upper electrode 87 to cause an organic light-emitting diode of the light-emitting layer 86 to emit light. The color filters 91R, 91G, 91B, and 91W pass the first to fourth colors, respectively. The black matrix 92 is a light-shielding layer. The substrate 90 is a substrate that holds the respective components of the image display panel 40*h* like the substrate 81.

The first and second modifications are examples, and the pixel array of the image display panel 40 according to the first embodiment can be applied to various other types of image display devices.

2. Application Examples

Figure 25:
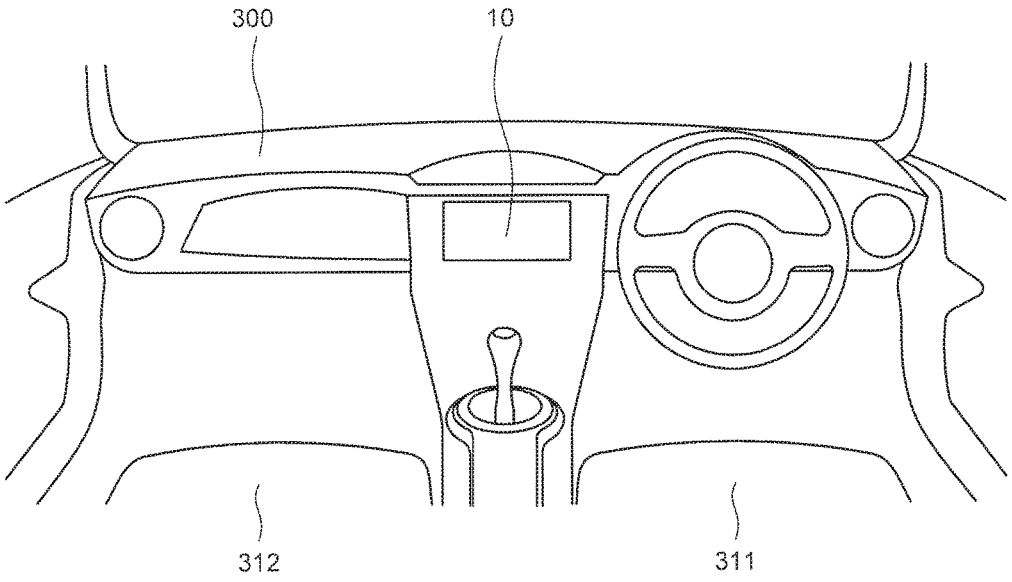
FIG. 25 is a diagram illustrating an example of an electronic apparatus to which the display device according to the first embodiment is applied.
Figure 26:
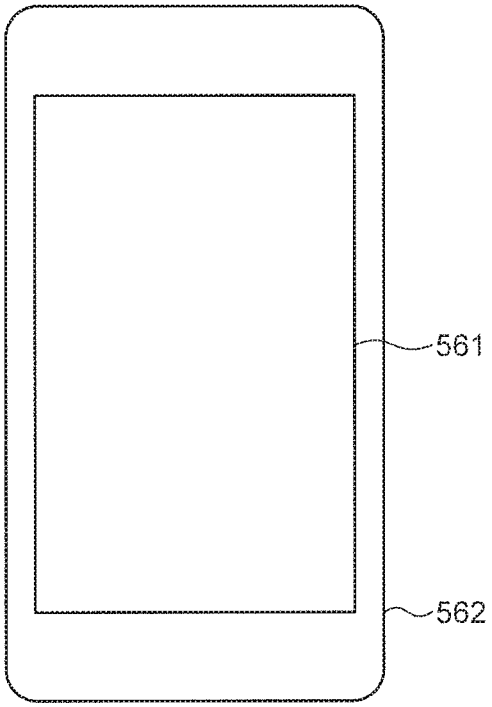
FIG. 26 is a diagram illustrating an example of an electronic apparatus to which the display device according to the first embodiment is applied.

Next, application examples of the display device 10 described in the first embodiment will be described with reference to FIGS. 25 and 26. FIGS. 25 and 26 are diagrams illustrating examples of an electronic apparatus to which the display device according to the first embodiment is applied. The display device 10 according to the first embodiment can be applied to all fields of electronic apparatuses such as a car navigation system illustrated in FIG. 25, a television device, a digital camera, a laptop personal computer, a portable terminal device such as a portable telephone illustrated in FIG. 26, a video camera, and the like. In other words, the display device 10 according to the first embodiment can be applied to all fields of electronic apparatuses that display a video signal input from the outside or a video signal generated inside as an image or a video. The electronic apparatus includes the control device 11 (see FIG. 1) that supplies the display device with the video signal, and controls an operation of the display device. The present application examples can be applied even to the display devices according to the other embodiments and the modifications in addition to the display device 10 according to the first embodiment.

The electronic apparatus illustrated in FIG. 25 is a car navigation device to which the display device 10 according to the first embodiment is applied. The display device 10 is installed on a dashboard 300 in a vehicle. Specifically, the display device 10 is installed at a portion of the dashboard 300 between a driver seat 311 and a passenger seat 312. The display device 10 of the car navigation device is used for a navigation display, a music operation screen display, a movie reproduction display, and the like.

The electronic apparatus illustrated in FIG. 26 is an portable information terminal to which the display device 10 according to the first embodiment is applied, and the portable information terminal operates a portable computer, a portable multi-function telephone, a portable computer with a voice call function, or a portable computer with a communication function and is called a smart phone or a tablet terminal as well. For example, the portable information terminal includes a display section 561 on the surface of a housing 562. The display section 561 includes the display device 10 according to the first embodiment and has a touch detection (so-called touch panel) function capable of detecting an external approaching object.

The embodiments and the modifications of the present invention have been described above, but the above embodiments and the like are not limited by content of the above embodiments or the like. A component which can be derived easily by those having skill in the art, substantially the same component, and a component of an equivalent scope are included as the above-described components. The above-described components can be appropriately combined. In addition, various omissions, replacements, or modifications of the components can be made within the scope not departing from the gist of the above embodiments or the like.

What is claimed is:

1. An image display panel, comprising:

a first pixel including (d−1) sub pixels, which are first to (d−2)-th sub pixels and a (d−1)-th sub pixel, d is an integer of four or more, each of the (d−1) sub pixels displaying a different color from at least another of the sub pixels in the first pixel;

a second pixel that is adjacent to the first pixel and includes (d−1) sub pixels, which are first to (d−2)-th sub pixels and a d-th sub pixel, each of the (d−1) sub pixels displaying a different color from at least another of the sub pixels in the second pixel, a first pixel display region; and a second pixel display region adjacent to the first pixel display region, wherein the first to (d−2)-th sub pixels of the first pixel, one part of the (d−1)-th sub pixel, and one part of the d-th sub pixel are arranged in the first pixel display region, the first to (d−2)-th sub pixels of the second pixel, the other part of the (d−1)-th sub pixel, and the other part of the d-th sub pixel are arranged in the second pixel display region, the first to (d−2)-th sub pixels of the first pixel are provided inside the first pixel display region, the (d−1)-th sub pixel of the first pixel is provided from the first pixel display region to the second pixel display region, the first to (d−2)-th sub pixels of the second pixel are provided inside the second pixel display region, the d-th sub pixel of the second pixel is provided from the second pixel display region to the first pixel display region, and the (d−1)-th sub pixel of the first pixel is adjacent to the d-th sub pixel of the second pixel in a direction intersecting to an adjacent direction of the first pixel and the second pixel.

2. The image display panel according to claim 1, wherein d is four, the first pixel includes a first sub pixel displaying a first color, a second sub pixel displaying a second color, and a third sub pixel displaying a third color, the second pixel includes the first sub pixel, the second sub pixel, and a fourth sub pixel displaying a fourth color.

3. The image display panel according to claim 2, wherein, the first sub pixel displays blue, the second sub pixel displays white, the third sub pixel displays green, and the fourth sub pixel displays red, the third sub pixel of the first pixel is provided from the first pixel display region to the second pixel display region, and the fourth sub pixel of the second pixel is provided from the second pixel display region to the first pixel display region.

4. The image display panel according to claim 2, wherein, the first sub pixel, the second sub pixel, the third sub pixel and the fourth sub pixel have same area.

5. The image display panel according to claim 2, wherein, the first sub pixel, the second sub pixel, the third sub pixel and the fourth sub pixel have same shape.

6. The image display panel according to claim 2, wherein, the first sub pixel of the first pixel has same area with the first sub pixel of the second sub pixel, the second sub pixel of the first pixel has same area with the second sub pixel of the second sub pixel the third sub pixel provided in the first pixel display region and the third sub pixel provided in the second pixel display region have same area, and are smaller than the first sub pixel and the second sub pixel, and the fourth sub pixel provided in the first pixel display region and the fourth sub pixel provided in the second pixel display region have same area, and are smaller than the first sub pixel and the second sub pixel.

7. The image display panel according to claim 2, wherein, the first pixel and the second pixel that are adjacent with each other form a pixel group, the pixel group is adjacent with an other pixel group in a direction intersecting to the adjacent direction of the first pixel and the second pixel which are adjacent each other, and, the pixel group is shifted from the other pixel group in the adjacent direction of the first pixel and the second pixel which are adjacent each other.

8. The image display panel according to claim 2, further including a plurality of scanning lines and a plurality of signal lines which are coupled with the sub pixels, wherein the third sub pixel of the first pixel shares, with the fourth sub pixel of the second pixel, one of the coupled signal lines.

9. The image display panel according to claim 8, wherein the plurality of scanning lines include a first scanning line and a second scanning line, the third sub pixel and the fourth sub pixel are provided between the first scanning line and the second scanning line, the first sub pixel and the second sub pixel of the first pixel face with the third sub pixel and the fourth sub pixel through the first scanning line, and the first sub pixel and the second sub pixel of the second pixel face with the third sub pixel and the fourth sub pixel through the second scanning line.

* * * * *